US012194371B1

(12) United States Patent
Curley

(10) Patent No.: US 12,194,371 B1
(45) **Date of Patent: *Jan. 14, 2025**

(54) CARD HANDLING APPARATUS WITH FAULTY DECK REJECTION

(71) Applicant: Charles M. Curley, Cortland, NY (US)

(72) Inventor: Charles M. Curley, Cortland, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/446,139

(22) Filed: Aug. 8, 2023

(51) Int. Cl.
*A63F 1/14* (2006.01)
*A63F 1/12* (2006.01)
*A63F 1/16* (2006.01)

(52) U.S. Cl.
CPC ..... *A63F 1/14* (2013.01); *A63F 1/12* (2013.01); *A63F 1/16* (2013.01)

(58) Field of Classification Search
CPC ..... A63F 1/14; A63F 1/12; A63F 1/16; A63F 2250/58
See application file for complete search history.

(56) References Cited

U.S. PATENT DOCUMENTS 4,586,712 A 5/1986 Lorber
5,669,816 A 9/1997 Garczynski
5,683,085 A 11/1997 Johnson
5,718,427 A 2/1998 Cranford
5,722,893 A 3/1998 Hill
5,944,310 A 8/1999 Johnson
5,989,122 A 11/1999 Roblejo
6,126,166 A 10/2000 Lorson
6,250,632 B1 6/2001 Albrecht
6,254,096 B1 7/2001 Grauzer
6,361,044 B1 3/2002 Block
6,403,908 B2 6/2002 Stardust
6,651,982 B2 4/2003 Grauzer
6,629,894 B1 10/2003 Purton
6,638,161 B2 10/2003 Soltys
(Continued)

*Primary Examiner* — Michael D Dennis
(74) *Attorney, Agent, or Firm* — Chris Tanner; BlueCollarIP.com

(57) ABSTRACT

An automatic playing card handling apparatus for use in casino card games possesses a card intake portal and a first card deck discharge portal which are both accessible by a dealer. The shuffling apparatus is controlled by a microcontroller which allows two fully-shuffled, but separated, card decks to be ready for play simultaneously. A first shuffled card deck is independently supported in the first card deck discharge portal by a retractable support structure while a second shuffled card deck remains ready for play while independently supported by an elevator just below the first card deck discharge portal. A third unshuffled card deck may coexist within the card intake portal. An optical recognition sensor cooperates with the microcontroller to interrogate the integrity of each deck during randomization to discover unreadable cards, unexpected cards, damaged cards or missing cards. If the microcontroller determines that a deck is faulty, then that faulty deck is automatically disgorged from the apparatus through a second discharge port into a secured or unsecured container. Three separated decks can be automatically routed through the apparatus in order to assure uninterrupted card play. Also disclosed is a method of randomizing two groups of playing cards.

16 Claims, 21 Drawing Sheets

(56) References Cited

U.S. PATENT DOCUMENTS

| | | | | |
|---|---|---|---|---|
| 6,651,981 | B2 | 11/2003 | Grauzer | |
| 6,676,127 | B2 | 1/2004 | Johnson | |
| 6,726,205 | B1 | 4/2004 | Purton | |
| 6,889,979 | B2 | 5/2005 | Blaha | |
| 7,036,818 | B2 | 5/2006 | Grauzer | |
| 7,367,561 | B2 | 5/2008 | Blaha | |
| 7,523,935 | B2 | 4/2009 | Grauzer | |
| 7,584,962 | B2 | 9/2009 | Breeding | |
| 7,677,565 | B2 | 3/2010 | Grauzer | |
| 7,753,373 | B2 | 7/2010 | Grauzer | |
| 7,764,836 | B2 | 7/2010 | Downs | |
| 7,766,333 | B1 | 8/2010 | Stardust | |
| 7,784,790 | B2 | 8/2010 | Grauzer | |
| 8,011,661 | B2 | 9/2011 | Stasson | |
| 8,038,521 | B2 | 10/2011 | Grauzer | |
| 8,485,527 | B2 | 1/2013 | Grauzer | |
| 8,366,109 | B2 | 2/2013 | Soltys | |
| 8,381,918 | B2 | 2/2013 | Johnson | |
| 8,419,521 | B2 | 4/2013 | Grauzer | |
| 8,444,147 | B2 | 5/2013 | Grauzer | |
| 8,556,263 | B2 | 10/2013 | Grauzer | |
| 8,646,779 | B2 | 2/2014 | Grauzer | |
| 8,807,348 | B2 | 8/2014 | Johnson | |
| 8,814,164 | B2 | 8/2014 | Baker | |
| 8,899,587 | B2 | 12/2014 | Grauzer | |
| 9,138,635 | B1 | 9/2015 | Sines | |
| 9,457,262 | B2 | 10/2016 | Shigeta | |
| 9,474,957 | B2 * | 10/2016 | Haushalter | A63F 1/12 |
| 9,504,905 | B2 | 11/2016 | Kelly | |
| 9,573,047 | B1 * | 2/2017 | Riordan | A63F 1/14 |
| 9,975,041 | B2 | 5/2018 | Gingher | |
| 10,022,617 | B2 | 7/2018 | Stasson | |
| 10,092,819 | B2 | 10/2018 | Haushalter | |
| 10,238,954 | B2 | 3/2019 | Stasson | |
| 10,532,272 | B2 | 1/2020 | Bourbour | |
| 10,668,361 | B2 | 6/2020 | Stasson | |
| 10,960,292 | B2 | 3/2021 | Stasson | |
| 11,173,383 | B2 | 11/2021 | Krenn | |
| 11,338,194 | B2 | 5/2022 | Helgesen | |
| 11,367,489 | B2 | 6/2022 | Tokutomi et al. | |
| 11,426,649 | B2 | 8/2022 | Rynda | |
| 2007/0102879 | A1 * | 5/2007 | Stasson | G07F 17/32 273/149 R |
| 2007/0238502 | A1 | 10/2007 | Pokorny | |
| 2015/0238848 | A1 * | 8/2015 | Kuhn | A63F 1/12 273/149 R |
| 2020/0171375 | A1 | 6/2020 | Litman | |

* cited by examiner (1997)

(1997)

(2003)

(2003)

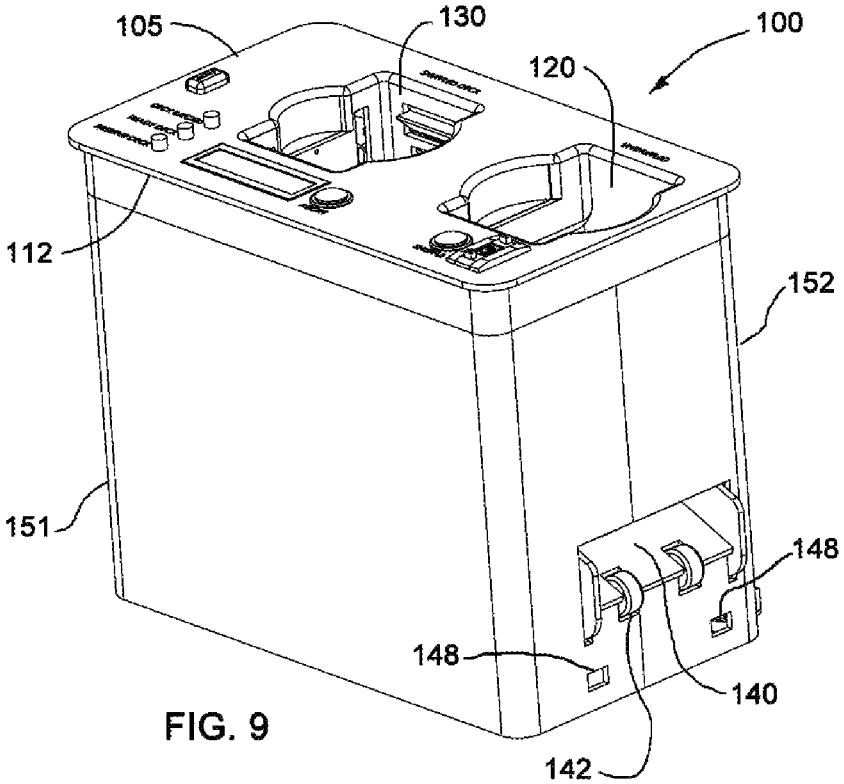
FIG. 9
FIG. 10
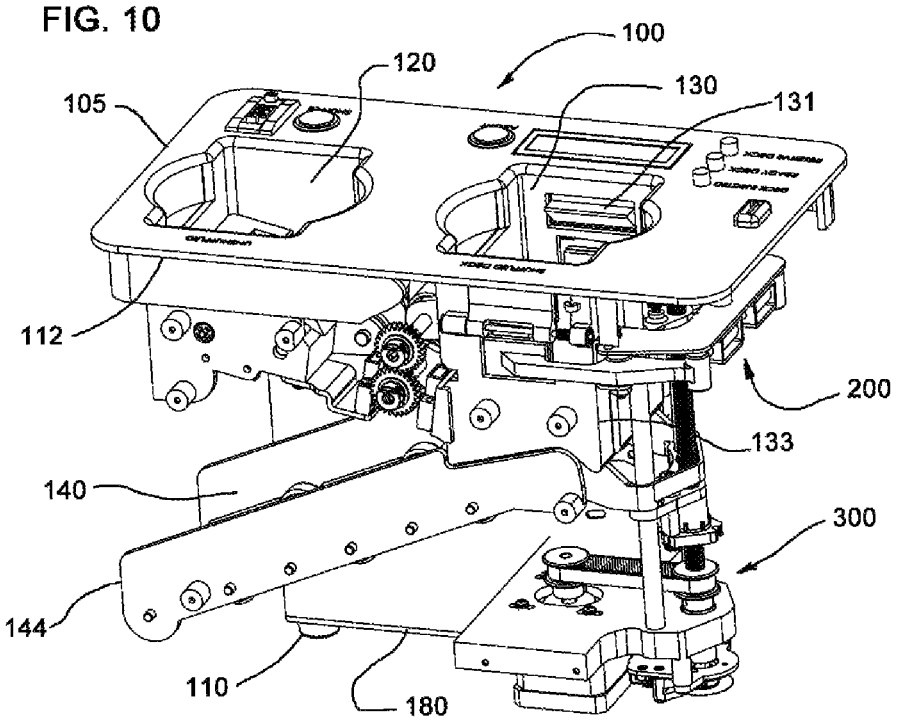

FIG. 13C
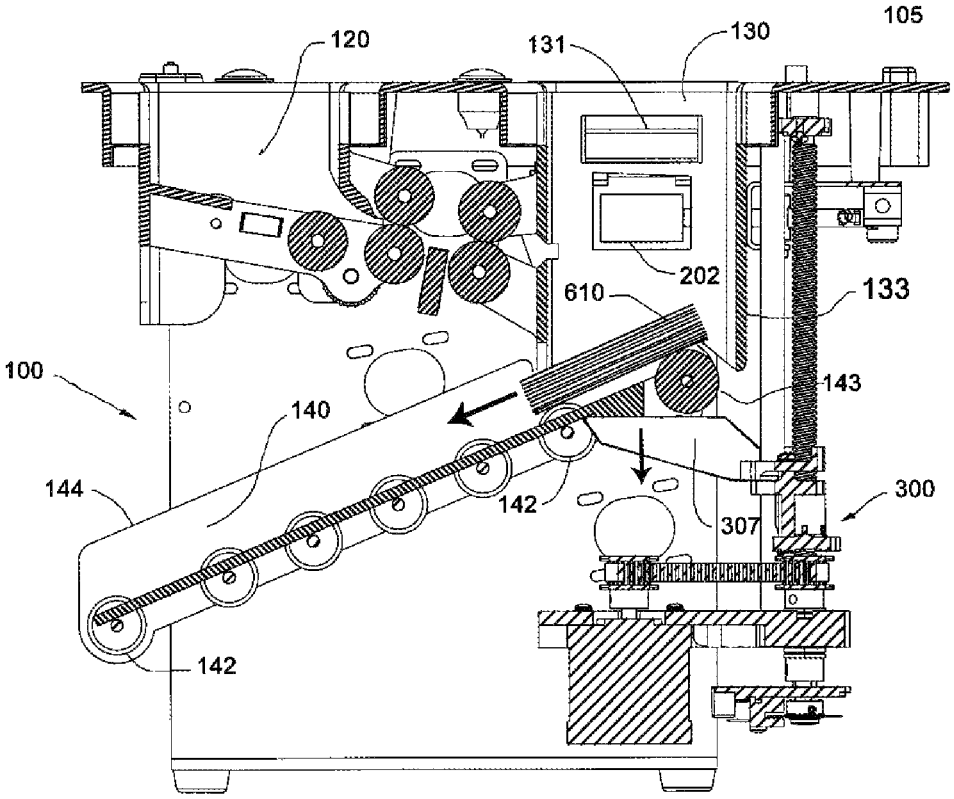
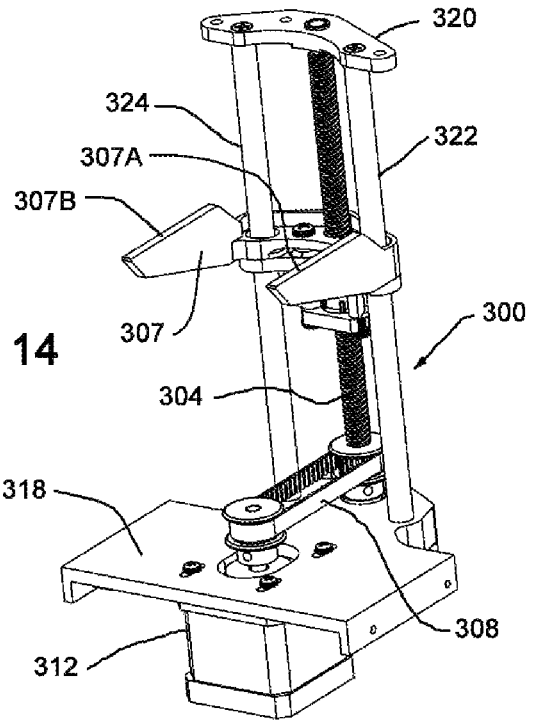
FIG. 14

FIG. 15
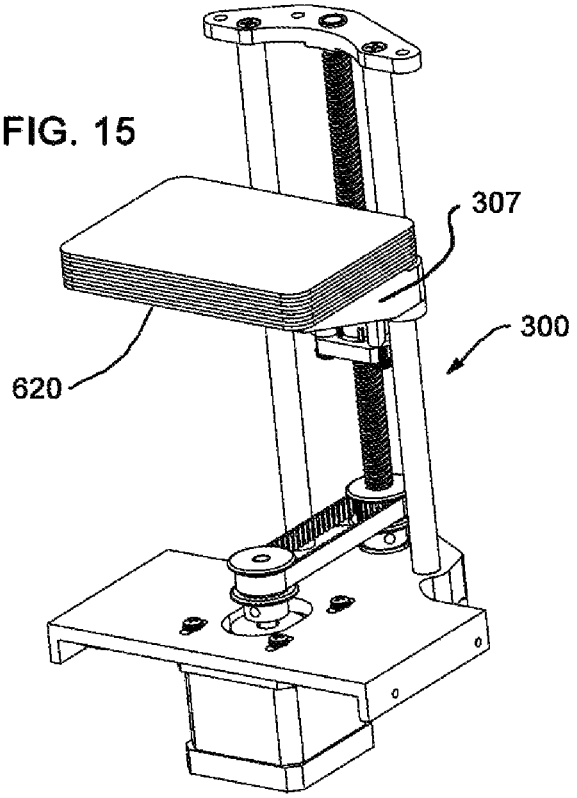
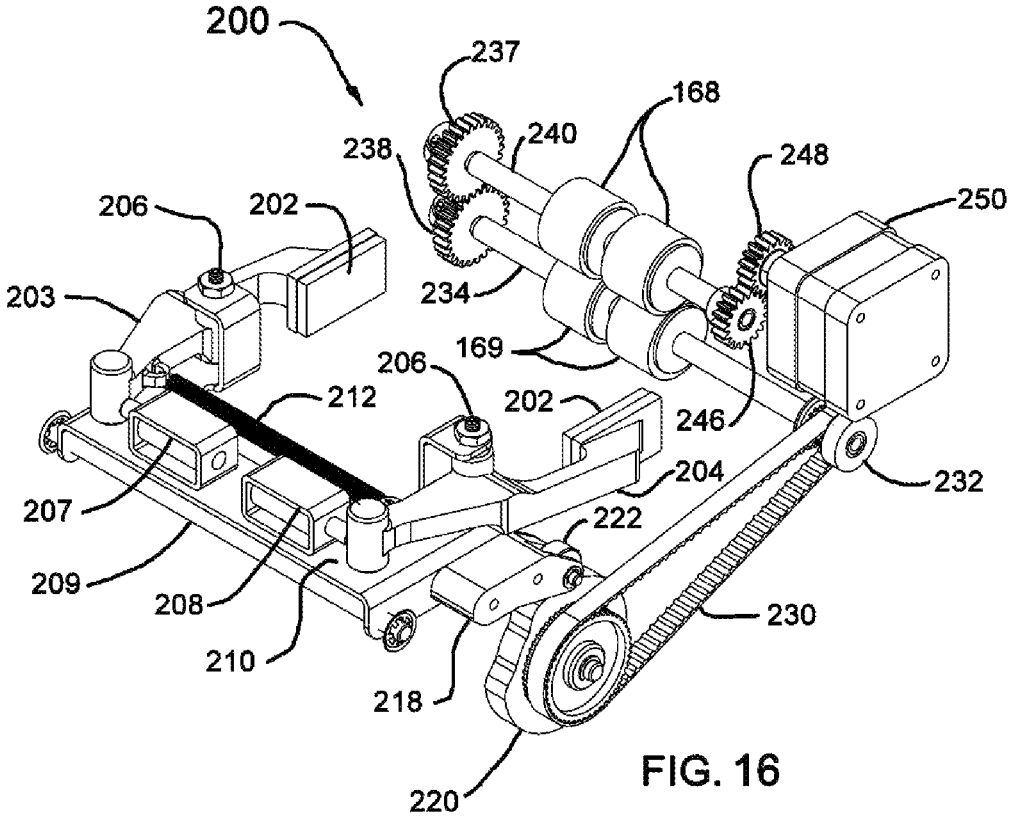
FIG. 16

FIG. 17
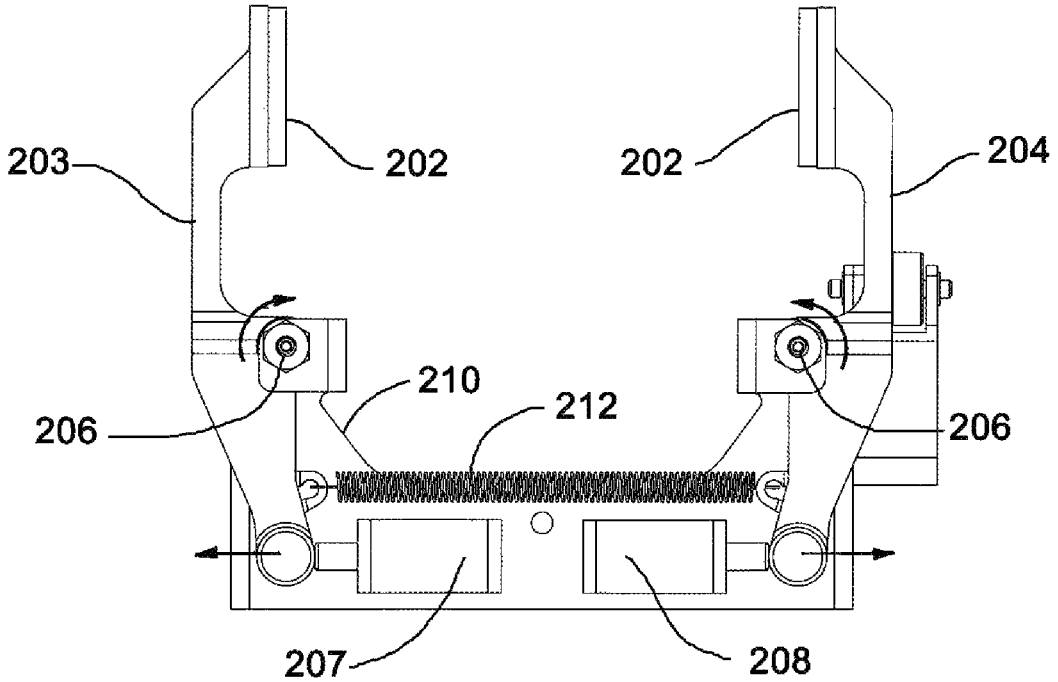
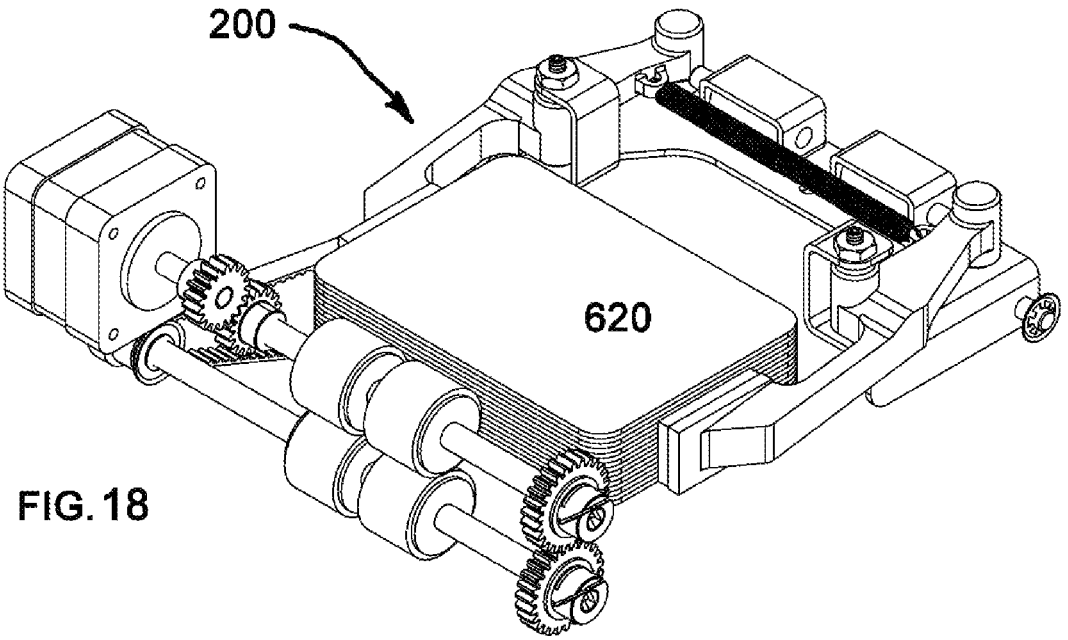
FIG. 18

EXAMPLE:
D = 4, P = RAND [ 1 TO D ]

EXAMPLE:
D = 9, P = RAND [ 1 TO D ]

CARD HANDLING APPARATUS WITH FAULTY DECK REJECTION

FIELD OF INVENTION

The present invention is related to the field of automatic electromechanical shuffling machines which are used by casinos to speed up the rate of play of dealer-hosted card games. More particularly, the invention relates to shuffling machines which randomize the rank and suit of cards within a single deck of playing cards, as for example for use in a game of single-deck Blackjack where a dealer issues playing cards to players from a single pre-shuffled deck of 52 cards.

BACKGROUND

Card games such as Blackjack are major attractions in casinos because they are relatively easy to play and allow wagering to various degrees of risk. A single deck of 52 playing cards is often used in these games, which must be periodically shuffled to effect randomness of the rank and suit of the individual cards within the deck. It is to the advantage of the casino to reduce the time that a dealer handles and shuffles playing cards between games, thereby increasing revenues. Casinos thus use automatic shuffling machines to speed up the rate of play at gaming tables, retaining the interest of the players and sustaining the rate of play.

Shuffling machines are relatively slow devices because they must handle each and every card in the deck, both to randomly rearrange its deck position and to verify its proper authenticity and existence. One way to sustain rate of table play in a casino is for the dealer to utilize a "two-deck rotation". Shuffling machines which facilitate the "two-deck rotation" usually possess an unshuffled card intake portal and a shuffled card discharge portal. Such a prior art example is shown in FIG. 1 as taught by U.S. Pat. No. 6,651,982 (Grauzer), where the recess 2026 is a card receiving portal for receiving unshuffled cards, and the recess 2032 is a shuffled card discharge portal. The unshuffled cards are released into the mechanism below the recess 2026 where they are randomly rearranged and thereafter raised to the recess 2032 by elevator surface 2014. Shuffling of another unshuffled deck is able to commence only after the newly-shuffled deck is removed from the elevator surface 2014 by the dealer. US'982 discloses in column 9 that a shuffling apparatus 2020 has a card accepting recess 2026 that has a lower support surface that slopes downwardly from the nearest outer side 2029 of the shuffling apparatus 2024. The card discharge portal 2032 possesses an elevator surface 2014 and two card supporting sides 2034.

While the shuffling machine is shuffling the previously "played" deck, the dealer uses a newly shuffled deck to execute the game with the players. When that deck is reasonably depleted, the dealer can then return that deck to the shuffling machine and fetch a newly shuffled deck from that machine, such that there is relatively little interruption in play. While the game is being played with one deck, a newly shuffled deck is being made ready within the automatic shuffler. However, the newly shuffled deck may be faulty and unfit for play, causing the dealer to delay the game until another deck is shuffled.

The prior art explains that automatic shuffling machines have traditionally utilized verification measures to ensure the integrity of the deck by sensing and tracking the rank and suit of every card within the deck during the shuffling process. Numerous prior art references teach optical recognition devices to verify that the deck is complete and does not contain extraneous cards. Automatic shuffling machines verify that each and every card of each suit is included as required by the game being played, and that there exists no missing or extraneous cards resulting from machine malfunction or cheating.

For example, prior art U.S. Pat. No. 5,989,122 (Roblejo) as reproduced in FIG. 2 discloses an automatic shuffler that utilizes an optical card reader 2044 which reads rank and suit of individual cards before they are moved from an unshuffled input stack 2042 to the randomizing mechanism. The role of the optical recognition device is to verify the composition and completeness of a set of playing cards prior to randomizing. US'122 explains that an apparatus 2040 has a control means 2041, an input means for receiving playing cards onto an input stack holder 2042, and buffer means having a plurality of slots for temporarily holding cards, illustrated as a wheel 2043 having a plurality of slots 2048. The apparatus additionally possesses identification means for reading indicia, illustrated as bar code reader 2044 to determine identity of playing cards which can be specially marked with bar codes or other coded information. Alternatively, the cards can be unmarked.

> "It is an object of this invention to provide an apparatus and method for receiving cards, either from new decks or after the cards have been played, to shuffle the cards in a randomized order, and simultaneously to verify the accuracy of the set or sets of cards in the deck or decks. (US'122 col. 2; lines 22-27)
>
> "The means for reading indicia is preferably either a bar code reader, Video optical System, optical Scanner, reader of hologram information, or reader of magnetic indicia. (US'122, col. 3; lines 65-67)"

US'122 also disclosed the use of the apparatus as a card deck verification apparatus, independent of its functions as a card shuffler:

> "In another aspect, the invention comprises a process comprising providing such an apparatus, feeding to the input means one or more cards either after they have been played in a game or from an unrandomized or unverified set, and manually retrieving a verified true set of cards from the stacking means." (US'122, col. 2; lines 53-58)

An excerpted illustration from prior art U.S. Pat. No. 6,629,894 (Dolphin Advanced Technologies) is shown in FIG. 3 and teaches alternative configurations of a digital camera (commonly known as a CMOS camera) arranged to inspect rank and suit of each card as a machine passes each card from one stack to another. Cards from a card stack 2000 on platform 2001 are fed from the bottom of the stack via a drive roller 2002 to pinch rollers 2007, which facilitate movement to card stack 2005. In one embodiment the cards of card stack 2000 are face down and a first camera 2003 reads the face of the cards within the card stack 2000 via a window 2004 of the platform 2001. A second digital camera 2006 can be mounted below the pinch rollers 2007 such that a face of the card can be read between the card stacks 2000 and 2005. In another embodiment, a camera 2006 is above the pinch rollers 2007 to read any cards that are face up between card stacks 2000 and 2005.

US'894 states:

> "The camera reads the face of the cards and using on board image processing, provides a data output which includes the suit and value portion of the face of the card. (US'894 col. 5; lines 67, col. 6; lines 1-3)
>
> "[A] a card stack may be supported by a platform through which a drive roller extends. This allows cards to be fed from the bottom of the stack. In this embodiment, the cards are placed face down. So that each card may be read by an upward looking digital camera, the platform is provided with a window or opening. In the alternative, the cards may be read between stacks, by a digital camera mounted above (with the cards face up) or below the pinch rollers (with the cards face down) which facilitate card transport between the two stacks." (US'894 col. 4; lines 60-67, col. 5; lines 1-3)

Prior art U.S. Pat. No. 6,638,161 (Soltys) discloses the use of a CMOS color sensor which is utilized for verifying individual cards within a deck. The sensor explained in that disclosure is a Model PB300 made by Photobit, which captures a 640×480 pixel color image of the indicia on playing cards, including the rank and suit. Prior art U.S. Pat. No. 5,669,816 (Garczynski) discloses the use of an array sensor to optically scan the rank and suit of playing cards by comparing pixel images with pixel images stored in memory. One of ordinary skill recognizes the array scanner as a pixel-based CMOS image sensor. Prior art U.S. Pat. No. 6,126,166 (Lorson) verifies rank and suit of individual playing cards by moving each card past an array of reflective sensors to capture a bit-mapped image of the card indicia. The bit-mapped images are compared to verified bit maps which are stored in memory.

Prior art U.S. Pat. No. 6,403,908 (Stardust) discloses the use of optical recognition for inspecting decks of playing cards by utilizing a scanner or digital camera to scan one card indicia at a time. US'908 explains that images taken by cameras are supplied to a comparison circuit in the control processor which compares these images with stored images of a corresponding deck of cards to determine which card and what color card is detected by the camera or cameras. A digital camera or scanner can be used.

Prior art U.S. Pat. No. 6,676,127 (Johnson) discloses a collating apparatus for providing sorted and/or shuffled decks of playing cards which utilizes a CCD digital camera. US'127 discloses that the camera is utilized to read the rank and suit of a deck of cards as each card passes by a scanning station. The camera described in US'127 is model EB100/E-6 made by EverFocus® Electronics, which is a 492×510 pixel CMOS camera. US'127 states:

"Thus, the device of the present invention is capable of accounting for all cards, and for producing an error signal when there are too few or too many cards. The device may also be equipped with a display that provides a visual indication of the particular cards missing or extra cards present, or the total card count." (US'127 col. 4; lines 64-67, col. 5; lines 1-2)

U.S. Pat. No. 5,722,893 (Hill) discloses an optical sensor used to scan the rank and suit of a playing card as a dealer removes each playing card from a card dispensing shoe. Verification is achieved by comparing bit maps from the sensor to bit maps that are stored in memory. US'893 states:

"The present invention is directed to a shoe of the type described wherein the shoe has a card scanner which scans indicia on a playing card as the card moves along and out of a chute by manual direction by the dealer in the normal fashion. The scanner can be one of several different types of devices which will sense each card as it is moved downwardly and out of the from of the shoe." (US'893 col. 1; lines 41-46).

Even with optical card recognition and verification means, mechanical shuffling machines are not infallible, and suffer from various errors caused by several sources including cheating, lost cards, flipped cards, contamination, bent cards and covertly inserted cards. The verification is useful however, because it can prevent further play with a card deck that suffers from various illicit conditions. For example, prior art U.S. Pat. No. 11,376,489 (Scheper) discloses the problem of the shuffler encountering lost cards or flipped cards. US'489 states:

"If the shuffler stops shuffling for any reason, such as detecting extra or fewer cards in the set, or due to a shuffler malfunction, the game may be delayed, and revenue can be lost. Although it is desirable to stop a game that is using an invalid set of cards for security reasons, there are other reasons why a game might be delayed, such as when a shuffler malfunctions or the shuffler aborts the shuffle because of unreadable cards." (US'489 col. 2; lines 57-67, col. 3; lines 1-2)

"Flipped cards and unrecognized cards typically cause the machine to abort the entire shuffle. Any time a shuffle is aborted, the game can be delayed, causing revenue loss to the casino." (US'489 col. 3; lines 5-14)

U.S. Pat. No. 11,173,383 (Krenn) discloses an apparatus to detect flipped cards in automatic shufflers, wherein the indica face of the playing card faces upward rather than downward. US'383 states:

"The card imaging device may be configured to identify whether a card face of the at least some of the playing cards are positioned in an expected orientation or whether the card face is in an unexpected orientation comprising one or more flipped cards." (US'383 col. 1; lines 67, col. 2; lines 1-4)

"When placing the cards in the discard pile and/or infeed area of a shuffling device, the dealer should reorient the cards face-down such that the cards are all oriented in the same way. However, cards are frequently reinserted into the card shuffling devices in the wrong face orientation. In additional embodiments, a new deck of cards may include cards in an erroneous orientation. Regardless of the case, cards inserted with the wrong face orientation may cause delays or errors in the automatic shufflers. For example, a card inserted in the wrong face orientation may cause the shuffling devices to stop the shuffle and alert the dealer through an error message or to abort the shuffle entirely resulting in a delay for the associated gaming table." (US'383 col. 5; lines 6-18)

Prior art U.S. Pat. No. 8,485,527 (Sampson) discusses the problem encountered by automatic shufflers due to damaged cards. US'527 states:

"Other mechanical shufflers frequently jam and thus fail to provide a shuffled deck ready for use in play without a delay while the shuffler is cleared, and a complete deck is then shuffled. Casinos frequently replace the decks of cards in play, but nervous or careless players may bend cards, or spill drinks, making cards likely to stick together, leading to some shuffler jamming." (US'527 col. 1; lines 47-58)

U.S. Pat. No. 10,092,819 (Haushalter) discloses the problems of players or dealers cheating when utilizing automatic card shuffling machines. One problem is the covert insertion of an extra card or cards by either a player or dealer. US'819 states:

"Automatic shufflers generally provide a higher level of randomization and security against cheating or mistakes compared to manual shuffling. However, players and dealers have been known to cheat or make mistakes that may lead one or more improper or unauthorized cards being introduced into a set of cards used in a particular game. For example, cards from another set may be inadvertently mixed with a set of cards being used, or a cheating player may attempt to introduce a card that is advantageous to the cheating player into the set of cards being used. Thus, true randomization of the cards may be compromised and the cheating player may gain an advantage." (US'819 col. 1; lines 26-37)

U.S. Pat. No. 9,975,041 (Gingher) discloses the problems of casino dealers who collaborate with players to cheat. US'041 explains:

"Conventional games of chance such as poker and blackjack have associated with them strict rules to combat cheating by players or collusion between the players and the dealer. Even with random card shuffling, players may identify patterns of cards that are not shuffled properly or dealers may replace a random deck with a pre-ordered deck for the purpose of cheating the house odds." (US'041 col. 9; lines 40-46)

US Patent application 2007/0238502 (Pokorny) also addresses the problem of player-dealer collusion. US'041 explains:

"A player may be in collusion with a dealer (who may have access to card identification by control of the shuffling), the player may have marked cards, the dealer may be purposely exposing cards before cards are dealt from the shoe, the cards may be pre-stacked with the order of the cards known to the player or dealer in collusion with a player, and the like." (US Application'502 col. 9; [0086])

Card damage in automatic shufflers is also dependent upon the complexity of the randomizing mechanisms. Several commercial shufflers use complex designs comprising a large array of individual card slots which are particularly prone to jamming due to bent or mildly warped cards. For example, several of today's commercial shuffling machines utilize the classic "Lorber Design" (U.S. Pat. No. 4,586,712) which is shown herein as FIG. 4. This classic configuration is based upon unloading cards from an unshuffled deck into the individual slots of a carousel, randomly rotating the carousel, and then pushing individual cards from the carousel slots and into a shoe.

As shown in the upper section of FIG. 4, an unshuffled card stack 2053 is deposited on edge into container 2052 of the automatic shuffling apparatus 2050. Individual cards are vertically stripped from the stack and moved downward from the left end of container 2052 and into a carousel 2062 by driven rollers 2054 and 2055. The carousel 2062 is described as a storage device 2060 which possesses a series of radially arranged addressable spaces 2064 which can be aligned with the edges of card stack 2053 of container 2052 for the purpose of inserting a card. A computer rotates a stepper motor (not shown) to insert cards in any random space within the carousel 2062. Individual cards are extracted from the randomly rotated carousel 2062 at the station shown in the bottom left section of the figure by the action of an ejecting device 2066. Driven rollers 2054 and 2055 move the individual cards into a newly created stack within the space 2068. The stack of cards within discharge portal 2068 has thus been arranged randomly (shuffled).

The Lorber design is known in the art as a certain class of shuffler called a "continuous shuffler", whereupon randomly arranged cards are continually supplied to a shoe in groups to replace those that a dealer has extracted. The Lorber design details that a loading cycle has 24 randomized cards which are automatically unloaded from the carousel into the shoe each time that a sensor determines that the shoe has become empty.

Other commercial shufflers use a linear version of the "Lorber Design", which substitutes a vertically moving linear comb mechanism for the carousel. For example, U.S. Pat. No. 6,254,096 (Grauzer) is shown herein as FIG. 5. Referring to FIG. 5, unshuffled cards are placed into an intake portal 2070 which possesses a card receiving well 2072. A stacked assembly of card receiving compartments 2080 is configured to move vertically under control of an elevator motor (not shown), which can position the compartments at random elevations under control of a microprocessor. Pick up roller assembly 2074 and pinch roller system 2076 then move individual cards into compartments 2082 which have been randomly elevated. The elevator is also thereafter randomly positioned for card removal at a lower level, whereupon a pusher 2078 pushes cards out of the compartments 2082 and into a card way 2086, which provides a channel for moving the cards. Ultimately, the cards are stacked below each other in a card discharge portal 2084 and form a buffer stack "B".

U.S. Pat. No. 9,138,635 (Sines) explains that playing cards become bent or warped during play. US'635 states:

"Throughout the course of play, it is not unusual for card players to hold cards in their hand and to warp or bend cards. Cards can also become warped or bent from the method by which a player or the dealer places them on the table or picks them up from the table." (US'635 col. 5; lines 51-55)

U.S. Pat. No. 11,338,194 (Helgesen) is illustrated herein as FIG. 6. This patent discloses a more recent version of the vertical adaptation of the classic "Lorber Design" which utilizes a vertically oscillating comb with narrow card slots. As shown in FIG. 6, a card storage device 2100 possesses a vertically moving rack 2106 which comprises slotted assemblies 2102 and 2108 into which individual cards are inserted. US'194 explains that the card rack 2106 is configured to translate in the vertical direction along a linear path- and that the card storage device 2100 includes a motor 2110 configured to drive movement of the rack 2106 up and down in the vertical direction. Each card storage compartment has a slot 2104 in the first side bracket assembly 2102 and a corresponding and complementary slot 2104 in the second side bracket assembly 2108.

US'194 additionally discloses the intuitive observation that inserting bent or warped cards into narrow slots is problematic. US'194 states:

"For example, one card in a deck may be bent or warped—causing the card to regularly fail to insert into its assigned upper or lower position during each shuffle." (US'194 col. 28; lines 63-65)

A simpler, and therefore more reliable, randomizing mechanism was taught by prior art U.S. Pat. No. 5,683,085 (Johnson), which discloses a randomizing apparatus that is devoid of narrow-slotted combs, racks and compartments. As shown herein as FIG. 7, Johnson discloses a shuffling apparatus which possesses a "main shuffling chamber" 2200. A mechanical gripping member 2208 is attached to a mechanical gripping arm 2206 which can move vertically to random positions in chamber 2200 as commanded by a microprocessor. The arm 2206 grips and the lifts sub-stack 2202 at random positions which enables the insertion of an individual card 2210 that has been moved from a deck of unshuffled cards residing in an intake portal 2212. The separating mechanism creates an opening between two sub-stacks 2202 and 2204, which allows the insertion of card 2210 from the intake portal 2212 into the receiving stack at the opening. US'085 simulates the well-known action that a dealer utilizes to manually insert a "cut card" into a deck as illustrated herein as FIG. 8A.

Prior art U.S. Pat. No. 6,651,982 (Grauzer) also adopted the Johnson gripper mechanism. Whereas US'085 has elevated the gripper to select a subset of cards, US'982 discloses that the gripper is held stationary, while the platform below is vertically lowered away from the gripper. The shuffler described in US'982 has a disadvantage because only one deck can be processed at a time. The elevator is used to support the final shuffled card deck in the discharge portal, thus preventing the use of the elevator for additional shuffling until the deck is removed by the dealer. U.S. Pat. No. 6,250,632 (Albrecht) discloses a shuffler with an elevator that suffers from the same problem. That shuffler cannot operate until a previously shuffled deck has been removed from the elevator at the discharge portal by the dealer.

The Johnson Method as shown in FIG. 7 of U.S. Pat. No. 5,683,085 (Johnson) can be further understood from FIGS. 8B and 8C where a generic gripper arm is labeled 640. The gripper arm is mounted to an elevator which positions the arm at a random vertical plane adjacent to the card stack 620 as shown in FIG. 8B. Referring to FIG. 8C, the gripper arm thereafter grasps a portion of the card stack 620U and lifts it upward, creating an opening to insert a playing card 626. The gripper arm then lowers the upper stack onto the lower stack. The cycle is repeated until the desired number of cards are inserted randomly into the card stack 620.

U.S. Pat. No. 6,631,982 (Grauzer) also utilized a gripper to separate a card stack into two sub-stacks. Referring to FIGS. 8D and 8E, US'982 mounted the gripper arm 640 in a vertically stationary position and instead moved the card stack 620 with the elevator. After splitting the stack 620, the sub-stack 620L was lowered to create the opening for inserting card 626. After insertion, the lower substack 620L was raised to abut against the upper sub-stack 620U and the gripper was released. As compared to US'085, US'982 lowered the lower sub-stack 620L rather than raising the upper sub-stack 620U as was taught by US'085.

Many prior art mechanical shufflers require multiple elevators or multiple intake portals. U.S. Pat. No. 6,361,044 (Block) allows multiple decks to be sequentially prepared for play. US'044 discloses a mechanical shuffler which is embedded in a casino table, where the shuffled card deck is raised by an elevator to a discharge portal at the surface of the casino table. The shuffled deck is obscured from visibility of the players by an automatically moveable hinged cover. However, US'044 requires multiple elevators and a large complex machine with serpentine card movement paths.

U.S. Pat. No. 7,523,935 (Grauzer) also disclosed a shuffler that was embedded into a casino table, such that the card intake portal and the card discharge portal were approximately flush with the casino table surface. Like US'044, US'935 also disclosed that an automatically opening cover could be utilized to obscure view of the shuffled cards in the discharge portal. A disadvantage of US'935 is that the shuffling operation for a second deck could not commence until a previously shuffled deck had been removed from the elevator surface that is parked at the discharge portal.

Other prior art discloses overly complex devices. U.S. Pat. No. 7,584,962 (Breeding) requires three elevators to shuffle one deck of cards. U.S. Pat. No. 10,960,292 (Stasson) and US Published Application No. 2020/0171375 (Litman) both require two elevators in addition to a narrow-slotted comb. U.S. Pat. No. 11,376,489 (Scheper) requires both an elevator and a narrow-slotted carousel. U.S. Pat. No. 7,766,333 (Stardust) requires four intake portals to shuffle one deck of cards. U.S. Pat. No. 6,726,205 B1 (Purton) requires two elevators to verify a single card deck utilizing a digital camera. U.S. Pat. No. 5,718,427 (Cranford) discloses a mechanical shuffler that requires two unshuffled card intake portals and a third discharge portal in order to shuffle a single deck.

Some prior art shufflers cease operation of the shuffling operation when encountering "faulty" card sets, thus requiring dealer attention which stops casino game play. U.S. Pat. No. 10,238,954 (Stasson) explains that the card shuffler ceases operation if there is a mismatch in the number of expected cards. US'954 states:

> "If so, the card shuffler 100 ceases operation and an error message is displayed on the data output device 296." (US'954 col. 23; lines 26-28).

U.S. Pat. No. 10,668,361 (Stasson) also describes an automatic card shuffler which ceases operation in the event of failed verification, thus stopping casino play, but does not explain the disposition or destiny of the remaining faulty deck whose cards remain trapped within the elevator comb. US'361 states:

> "In the event that the verification process determines that the set of cards is incomplete or otherwise inaccurate, the card shuffler 100 may be configured not to dispense the shuffled cards and to display an error message or other signal to a user using the data output device 296 of the control system 280." (US'361 col. 24; lines 57-62)

An exemplary shuffler disclosure is U.S. Pat. No. 8,381,918 (Johnson) which explains a carousel shuffler with an optical recognition device and a control panel that notifies the dealer when a faulty deck is identified and may also reject individual faulty cards. US'918 states:

> "For example, a reject mechanism 8 may be associated with the sensor 15 to cause duplicate or oversupplied cards to be rejected before delivery by delivery carriages 18 to the magazine 20. The reject mechanism 8 may comprise an electromechanical device or air blast means coupled to the microprocessor 16. (US'918 col. 5; lines 29-34)

> "At the end of sorting, if any deck of cards is incomplete or over-supplied, a warning signal will be actuated in association with that deck to indicate the incomplete or oversupplied stack of cards. By actuating a liquid crystal display (LCD) or light-emitting diode (LED) display 28, this will indicate which card is missing or over-supplied and will also then indicate any other deck which is incomplete or over-supplied." (US'918 col. 4; lines 46-52)

US'918 distinguishes itself from others by the faulty card reject mechanism. However, US'918 makes no attempt to explain how the resulting faulty deck, which remains trapped in the carousel, can become cured of the fault. It is clear that the dealer would need to unload the carousel, search a new deck for each identified missing rank and suit duplicate, add the replacement, and then would need to be restart the shuffling cycle, resulting in considerable interruption of the game.

U.S. Pat. No. 8,646,779 (Grauzer) discloses a compartment-type moving rack or carousel shuffler which holds "one card per shelf or slot" and possesses optical card recognition means. US'779 discloses that the apparatus will abort the shuffling operation and thereafter requires the unloading of the slotted comb or carousel upon detecting a faulty card count. Such an incremental unloading sequence will require at least 192 rotations of the carousel or 192 vertical oscillations of the moving rack, and result in a significant interruption of the card game.

"If the card count reveals an insufficiency (e.g., fewer than 192 cards), the device may pause and the dealer and/or other casino employees will visually examine the table to see if cards were inadvertently left out of the count. The shuffler may also have the capability to abort a shuffling procedure and require a reloading of cards." (US'779 col. 23; lines 12-17)

"After such an indication, security would be called (either by floor personnel or by direct signal from the microprocessor) and an immediate count (mechanical and/or manual) of all the cards would be made." (US'779 col. 23; lines 27-31)

US Publication No. 2021/0072018 A1 (Krenn) describes a highly complex compartment-type shuffler that may utilize either a carousel or a vertically movable comb. The apparatus can randomize a single 52-card deck of standard playing cards and includes a "defect detection system". The "defect detection system" includes an optical card recognition sensor that can identify rank and suit of each individual card, allowing the controller to thereafter utilize an output mechanism to divert faulty cards to a temporary storage compartment. The defective cards include cards whose "rank and suit cannot be determined, is marked, or otherwise adulterated". In one embodiment, the temporary storage compartment is referred to as "a vault".

The "vault" is a "removable rectangular prism and sized to hold bulk quantities of bent, folded, creased, kinked, and/or frayed cards in the other compartment for subsequent removal, inspection, recycling, repurposing, or any combination of these". Although not specifically mentioned, one of ordinary skill will understand that the unreadable cards must also be diverted to the removeable vault. Nowhere in the publication do the inventors explain what action is taken by the apparatus after a faulty card has been detected and diverted to the isolation chamber, leaving a partially shuffled deck trapped within the carousel. The process of diverting just one faulty card in itself creates a remaining faulty deck.

As a casino table shuffler, the apparatus of US Publication No. 2021/0072018 A1 is not practical. If one unreadable card is diverted to a separate chamber before entering the carousel, the carousel will be left with 51 cards. Upon randomly unloading the carousel (shuffling), the deck sent to the discharge portal will comprise only 51 cards, leaving that deck unusable. One remedy is to unload the shuffler apparatus, identify the rank and suit of the missing card, fetch a new deck, search that deck for a duplicate, add the duplicate to the 51 card deck, and then reload the carousel. A quicker remedy is to simply unload the carousel and thereafter reload the carousel with a new deck, wherein the faulty card in the isolation chamber will no longer have any utility or meaning. Any of the multiple possible steps required to remediate the isolated card problem will cause a significant interruption in an on-going casino card game.

It can be observed that compartment-type shufflers (carousel or moving comb) require laborious, time-consuming activity to be unloaded when a faulty deck or card set is identified. In contrast, batch shufflers which handle discrete decks can be unloaded more quickly. U.S. Pat. No. 10,022,617 (Stasson) discloses a batch shuffler apparatus described as a "shuffling and verifying apparatus" which discloses an optical recognition device called an IDC ("image data-taking component") which is intended to read rank and suit of cards. US'617 states:

"The card verification device of the present invention may be used to read and verify cards at various stages of card use, as the verification of cards is often desirable before, and after play of casino card games." ('617 44:8-11)

Nowhere in US'617 do the inventors explain what action is taken by the apparatus when a faulty deck has been detected. Since the apparatus has but one card deck discharge portal, it is clear that the faulty deck must be raised to that discharge portal and thereafter manually removed by the dealer. Thereafter, the table game must be suspended until a new replacement deck can be shuffled. Alternatively, a dealer in collusion with a cheating player may simply continue the card game with the faulty deck.

U.S. Pat. No. 10,532,272 (Bourbour) also describes a batch shuffling apparatus. The specification explains:

"When combined with the ability to read card rank and suit, the device is capable of verifying that all cards are present and verifying the final order of the cards." (US'272 col. 17; lines 7-10)

"In one example of the invention, if cards are missing or extra cards are present, the display will indicate a misdeal and will automatically unload." (US'272 col. 17; lines 31-33)

US'272 did not disclose a means for the apparatus to automatically unload a faulty deck of cards. Instead, the apparatus is only capable of elevating the faulty deck to the card deck discharge portal where it must be manually removed by the dealer. US'272 thus suffers from the same limitation as the US'617 described above. Since the elevator of the randomizer mechanism is used to hold the faulty deck in its discharge portal, the apparatus cannot commence the processing (shuffling & verification) of another replacement card deck until that faulty deck is manually removed. The casino game may therefore be stopped until a new deck is inserted into the apparatus and thereafter shuffled, causing interruption of the casino game. Furthermore, that apparatus is vulnerable to dealer-player collusion because the dealer is responsible for manually removing a faulty card deck.

US'272 utilizes a single elevator to automatically verify and/or shuffle multiple discrete decks of cards. This is not to be confused with those devices that shuffle multiple decks of cards by intermixing the individual decks. For example, the device described in prior art U.S. Pat. No. 8,899,587 (Grauzer) can shuffle two decks of cards, but it is unable to keep the two decks separated into sets, and instead describes combining two 52-card decks into one set of 104 cards. The apparatus in US'587 has no capability to keep the individual decks separated into sets or to individually verify each 52-card deck.

U.S. Pat. No. 7,784,790 (Grauzer) explains a "continuous shuffler" type that uses a rack of vertically arranged compartments for randomizing, in the same way as carousel shufflers. Multiple decks of cards are recirculated through the shuffler as a card game is played, and sensors are utilized to resupply continuous randomized cards to the shoe as the dealer removes them. Spent cards are inserted periodically to the intake portal by the dealer. The apparatus of US'790 cannot assure the security of the cards because it cannot detect if a player or dealer has covertly inserted or extracted cards during the continuing operation. This is an exemplary security problem characteristic of "continuous shufflers" types. While they offer a continuous supply of cards, the cards are insecure unless the game is stopped, and all cards are rounded up and interrogated.

US'790 explains that the dealer must periodically halt the apparatus and the card game to perform a security check. The cards on the casino table must be rounded up, and the combined group of cards (up to 4 decks) must be reinserted into, and interrogated by the apparatus. Below is an excerpt from claim 20 of US'790.

"[the microprocessor is programmed to: receive signals from sensors and count cards entering and being removed from the shuffling chamber and to maintain a count of cards present in the shuffling chamber; receive instructions from an apparatus user to initiate a card counting process, wherein the card counting process includes a) discontinuing operation of the card removal process, b) pausing until cards outside of the shuffling chamber are loaded into the shuffling chamber, c) receiving an indication from the at least one sensor of i) sensing the presence of a card as the card is being fed into the shuffling chamber."

In view of the various complex designs and problems explained above that insufficiently resolve reliability, a simple reliable mechanical shuffler is needed that can overcome the problems that can shut down a shuffler in the view of sustaining continuous game play, and also prevent cheating such as player-dealer collusion. What is needed is a reliable, simple and compact card handling apparatus and method that can assure continuous play at a casino table without interruption, utilizing securely interrogated cards. When the dealer reaches for the newly shuffled deck in the discharge portal, he must be assured that such a deck has both been properly verified and sufficiently randomized.

SUMMARY

One solution to the many problems explained in the prior art is to introduce a reliable, automatic card handling device that can maintain a multiple deck rotation that incorporates three decks. Such a solution requires that a shuffled and verified deck is available to the dealer at the moment that he/she decides to retire the deck that is being played to the shuffler. In a three-deck rotation, two previously shuffled decks are normally available when the dealer discards an unshuffled deck to the card intake portal of the shuffling apparatus. In the present application, the two previously shuffled decks are designated the "ready deck" and the "reserve deck". These two decks can only be available after having been successfully verified, resulting in no interruptions in the rate of play. One of the ways the apparatus of the present invention distinguishes itself from other shuffling devices of the prior art is that the present invention does not permit a faulty card deck to reach the card deck discharge portal.

The apparatus and method of an embodiment of the present invention utilizes a playing card handling apparatus which includes one card intake portal and one card deck discharge portal, which may be arranged side-by-side on the device housing and readily accessible to a dealer. The apparatus possesses a randomizing mechanism for shuffling the cards, and an optical recognition sensor configured to verify the integrity of the deck by reading the rank and suit of each card. A first shuffled card deck is delivered as a "ready deck" to the shuffled deck discharge portal where it is supported by a retractable support structure. Thereafter, a second shuffled deck is created. The second deck is designated as the "reserve deck", and is supported by an elevator just below the "ready deck" where it is not visible to the players or the dealer. This position of the elevator, while supporting the "ready deck" just below the "reserve deck", is referred to as the elevator's "footprint position". The verification status of the "ready deck" and the "reserve deck" are both visibly observable by the dealer at the control panel such that the dealer can anticipate and remediate future delays. An embodiment of the present invention requires only one elevator to prepare multiple play-ready decks.

At least some embodiments of the invention herein are based partly upon a principle that faulty card decks are expendable. There is no economic incentive for a dealer to interrupt a card game to unload a shuffling apparatus to mitigate a faulty card deck. Rather, such an interruption has negative economic impact. It is counterproductive to interrupt a casino card game to remedy a card deck with a missing card. The dealer must rifle through a new deck to find the appropriate replacement card, and then appropriate that card from a new deck to salvage a worn deck. It is equally counterproductive to interrupt a card game to repair a faulty deck having an extra card. The dealer must find the two duplicate cards, compare them, and then discard that duplicate card which is deemed inappropriate. Inadvertently, the retained card duplicate may have covert markings.

Casinos frequently replace card decks because they become soiled (contaminated) by body oils, food or drink residue which render them unreadable by optical recognition means. Embodiments of the present invention herein includes optical recognition means for determining if a shuffled deck is contaminated or faulty, and thereafter automatically removes faulty decks from the other decks in the rotation. There is little economic motivation to decontaminate, cure or reconstruct a faulty deck of cards. Unreadable cards will remain unreadable, especially if contaminated. Bent or warped cards will remain so. Card shortages cannot be remedied without a laborious effort which would require searching for, and stealing the equivalent missing card's rank and suit from another new deck, thus spoiling a new deck to repair a worn deck. A more expedient choice is simply to discard the contaminated or faulty deck at the time that it is identified as being problematic. In an embodiment of the present invention, a contaminated or faulty deck is automatically removed to a discharge port by utilizing the same elevator that is used to randomize the deck sequence, thereby eliminating the need for individual card diverter mechanisms as taught by the prior art. Faulty card decks are automatically removed from the game table rotation. To the extent that a dealer may be tempted to repair or reconstitute a faulty deck, or to continue a game with a faulty deck, he/she cannot do so.

The apparatus of an embodiment of the present invention herein also prevents cheating, both of the form unknown to the dealer and of the form of player-dealer collusion. The dealer is deprived of the opportunity to continue play with card decks that have been deemed faulty by automated interrogation.

The apparatus of an embodiment of the present invention possesses a randomizing mechanism for shuffling the cards, and an optical recognition sensor configured to verify the integrity of the deck by reading the rank and suit of each card. Additionally, the apparatus possesses an intake portal and two card deck discharge portals. A first discharge portal is utilized to present "non-faulty" card decks, while faulty card decks are directed to a second discharge portal. Once randomization has been completed, the microcontroller observes the "fault status" of a randomized deck, determining if the card count is proper or if there exist unreadable, missing, duplicated or unexpected cards in the processed deck. The microcontroller additionally compares the rank and suit of the entire deck against an inventory that is expected, as programmed for individual card games. If the deck is found to be faulty, the elevator moves the faulty deck to the second discharge port where that deck is disgorged to a container such as a wastebasket or other container where it may be later interrogated, if desired. "Non-faulty" decks are moved to the first discharge portal. Any deck that reaches the first discharge portal is guaranteed to have been properly verified, such that a dealer is never faced with the task of unloading or reloading the shuffling apparatus, or reconstructing faulty decks.

A first shuffled "non-faulty" card deck is delivered as a "ready deck" to the first card deck discharge portal, and a second shuffled deck is held as a "reserve deck" below the "ready deck" and within the footprint of the "ready deck", if it is not faulty. In this way, the verification status of the "ready deck" and the "reserve deck" are both assured, and the dealer cannot encounter future delays due to faulty decks. Embodiments of the present invention require only one elevator to prepare multiple play-ready decks.

The randomizing mechanism of an embodiment of the present invention is devoid of narrow slots (or otherwise slot-less), carousels, combs, racks, or ejector blades that are previously known to be vulnerable to jamming. A section of the card stack being randomized is raised by a gripper mechanism which creates a randomly chosen wedge-shaped opening for oblique insertion of a card from the unshuffled stack, raises an upper sub-stack, and thereafter lowers the upper sub-stack onto the newly inserted card. The large wedge-shaped opening is tolerant of the elevator position (also known as "position tolerant") during card insertion, thereby reducing the vulnerability to bent or warped cards, as is the problem with narrow-slotted mechanical shufflers.

As a card game is played, exhausted card hands are discarded to the card intake portal by a dealer until such time that the dealer decides to retire the entirety of that deck to the intake portal for shuffling. In one embodiment, the dealer pushes a button that commands that deck to be shuffled, picks a previously shuffled card deck (the "ready deck") from the first discharge portal, and then continues the card game that is in progress. The shuffling machine detects that the "ready deck" has been removed, and thereafter moves a second shuffled "reserve deck" to the first discharge portal. The "reserve deck" thereafter becomes the "ready deck". When the apparatus completes the next verification and shuffling task, the newly shuffled deck is moved to the "reserve deck" position, as long as it is determined "non-faulty".

The apparatus of the present invention is advantageous because it assures a dealer that the previously shuffled decks are not faulty, and are instead ready for play (randomized and verified) at the time that he/she retires a previously-played deck to the card intake portal to be shuffled.

The apparatus of the present invention additionally prevents cheating. Illicit decks that possess covertly inserted extra cards or have had cards removed covertly, are automatically eliminated from further play, and the dealer has no discretion to continue the game with illicit card decks.

Another advantage of the verification mechanism is that friction rollers are used to individually move the playing cards past the optical reader. The friction rollers strip each playing card relative to an adjacent playing card, regardless of stickiness between adjacent playing cards that might be introduced by snacks or beverages being used at the casino table. The friction roller strippers increase the likelihood that each playing card will be successfully read during the verification process.

A further advantage of the present invention is that the wedge-shaped insertion opening makes the apparatus tolerant of elevator positional error (also known as "position tolerant") when inserting bent or warped playing cards during the randomizing process.

Another advantage of the present invention is the simplicity and reliability of the randomizing mechanism which utilizes only one elevator and avoids the complexity, high manufacturing costs and jamming vulnerability associated with narrow-slotted randomizing mechanisms and multi-elevator shufflers.

A yet further advantage of the present invention stems from relieving the dealer (operator) of any distraction or interruption in table play that would otherwise require a dealer to unload a card handling apparatus and thereafter manually disassemble, reconstruct or cure contaminated card decks when such decks are automatically detected by the apparatus.

BRIEF DESCRIPTION OF THE DRAWINGS

FIG. 9 is a perspective view of the card handling apparatus being described herein.

FIG. 10 is an isometric view of the of the apparatus in FIG. 9 with the outer housing removed to show the internal chambers.

FIGS. 13A, 13B and 13C are side elevational views of the apparatus which stepwise illustrate the migration of playing cards as they move through the apparatus.

FIG. 14 is an isometric view of the elevator module.

FIG. 15 is an isometric view of the elevator module showing the position of a subset of randomized cards.

FIG. 16 is an isometric view of the of the gripper mechanism which is used to grasp and raise a sub-stack of randomized cards.

FIG. 17 is a planar view of the gripper mechanism used to randomize cards.

FIG. 18 is an isometric view of the gripper mechanism while grasping a stack of cards.

DETAILED DESCRIPTION

Figure 1:
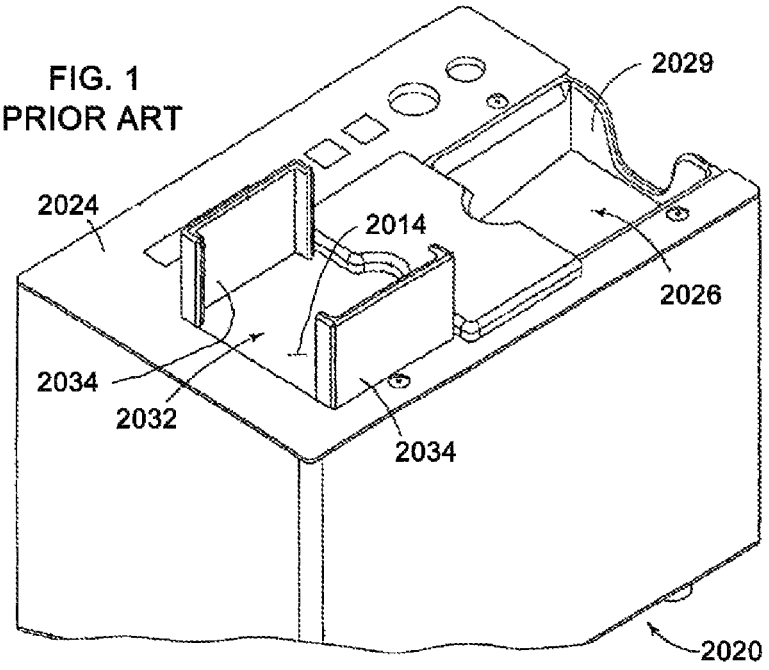
FIG. 1 PRIOR ART
FIG. 1 shows a prior art example of a shuffling machine console which includes a card receiving intake portal and a shuffled card discharge portal.
Figure 2:
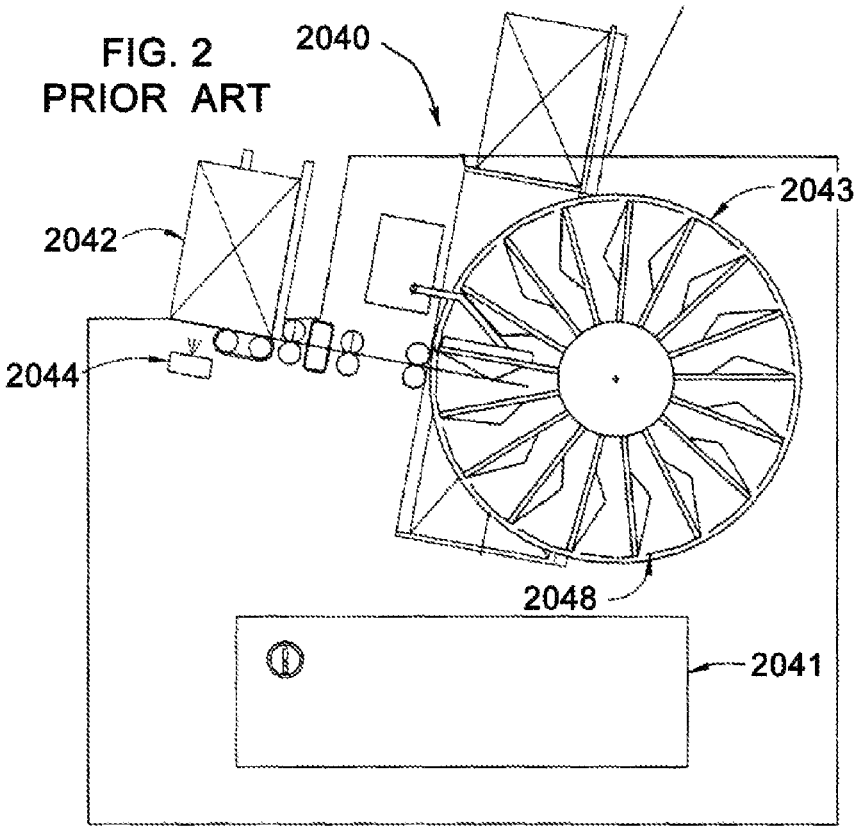
FIG. 2 PRIOR ART
FIG. 2 shows the configuration of a prior art carousel-type automatic shuffler that utilizes an optical reader to verify the composition and completeness of a set of playing cards during the randomizing process.
Figure 3:
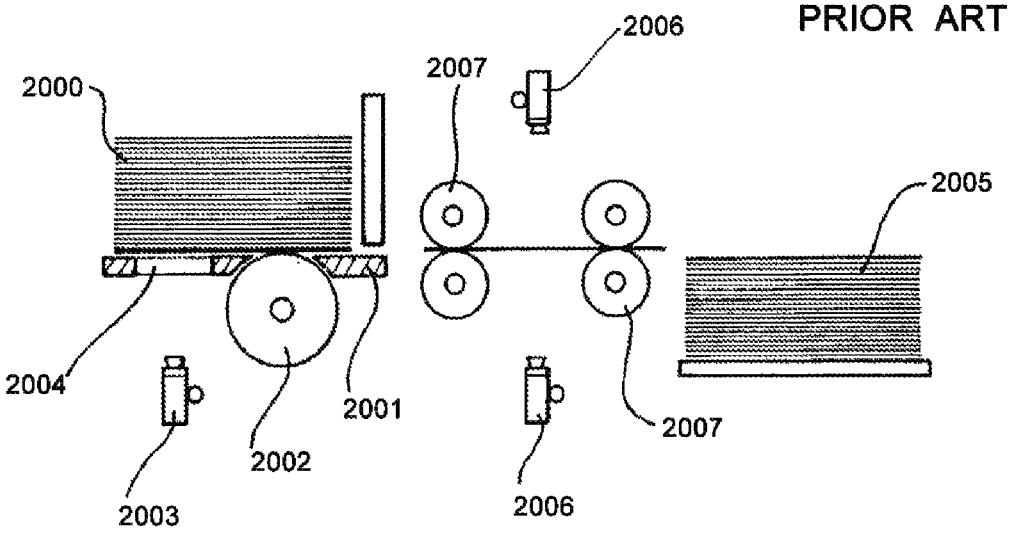
FIG. 3 PRIOR ART
FIG. 3 shows alternative arrangements of a digital camera configured to verify a stack of cards by using optical recognition to inspect rank and suit of each card as a machine passes each playing card from one stack to another.

A card handling apparatus for automatically shuffling and verifying multiple decks of playing cards is described for use in casino card games such as blackjack or twenty-one which are hosted by a card dealer at a casino table, although the card handling apparatus can be used with other card games played in a casino without departing from scope of the invention.

For purposes of this explanation, the term "spent deck" is defined as a deck of cards having been used in a card game previously and in need of being shuffled and verified. The term "processed deck" is defined as a deck of cards that has been transformed from a "spent deck" into a shuffled (randomized) deck, and has additionally been interrogated by the apparatus described herein. The term "non-faulty deck" refers to an interrogated card deck that exhibits no faults after being interrogated. The term "card intake portal" is defined as the depository cavity within the housing of the invention whereupon a new or spent deck is deposited by the dealer for the purpose of being transformed into a processed (shuffled and verified) deck. The term "first discharge portal" is defined as the cavity within the apparatus housing where the "non-faulty" processed decks are deposited by the apparatus for removal by a dealer. The term "second discharge portal" refers to the portal where faulty decks are disgorged from the apparatus.

An isometric view of the mechanical shuffling apparatus 100 is shown in FIG. 9. The apparatus 100 comprises a control console 105 which includes a recessed card intake portal 120 for receiving a new or spent (unshuffled) deck of playing cards from a dealer, and a first card deck discharge portal 130 for receiving a processed deck of playing cards from the randomizing mechanism that resides below that tray. A second discharge portal 140 is utilized to automatically disgorge faulty decks from the apparatus 100. The recessed cavity within discharge portal 130 includes a retractable support structure 131 whose purpose is to support a processed deck of cards. Casing members 151, 152 enclose the mechanism of the apparatus 100 and mount to the underside of the console 105.

The apparatus 100 may be inserted into a cavity in a casino table surface such that only the control console 105 is visible to the dealer and the casino players. Alternatively, the apparatus 100 may reside on the top surface of a casino table, supported by rubber feet 110 (see FIG. 10). In the embedded table configuration, the lip 112 is intended to rest upon the table surface, thus supporting the apparatus 100 which is placed near the dealer within arm's reach, such that the dealer may easily insert and withdraw card decks from the portals 120, 130. When mounted into the casino table, the table surface may completely surround the periphery of control console 105, and the discharge port 140 will be located below the surface of the playing table. Alternatively, the apparatus may be partially embedded at the edge of a casino table surface with portions of the apparatus viewable or accessible on the dealer side of the table, but at a level below the casino table surface that may not be viewable by the table players.

A goal of the apparatus 100 is to prepare card decks for play by shuffling those decks (randomizing) and interrogating those decks for irregularities such as missing cards or unreadable cards, and to thereafter to make only verified card decks available to the dealer. A further goal is to provide a "ready deck" in the shuffled deck tray and another play-ready "reserve deck" in a location below the "ready deck", such that both are available when the dealer retires a new or spent deck to the card deck intake portal. The apparatus 100 removes faulty decks from play and signals the dealer the reason for the ejection. The apparatus 100 additionally allows the dealer to queue up three decks at the beginning of a card game.

FIG. 10 shows an isometric view of the apparatus 100 with the casing removed. The various components are supported by side frames, and one side frame has been removed from the view to reveal the internal chambers. Side frame 180 is shown on the far side of the mechanism along with one of four rubber feet 110 which support the apparatus when removed from the casino table for service or maintenance. An elevator mechanism 300 is located directly below the card deck discharge portal 130, and a deck ejection portal 140 (second discharge portal) is shown sloping away from a lower portion of a randomizer housing 133.

Figure 11:
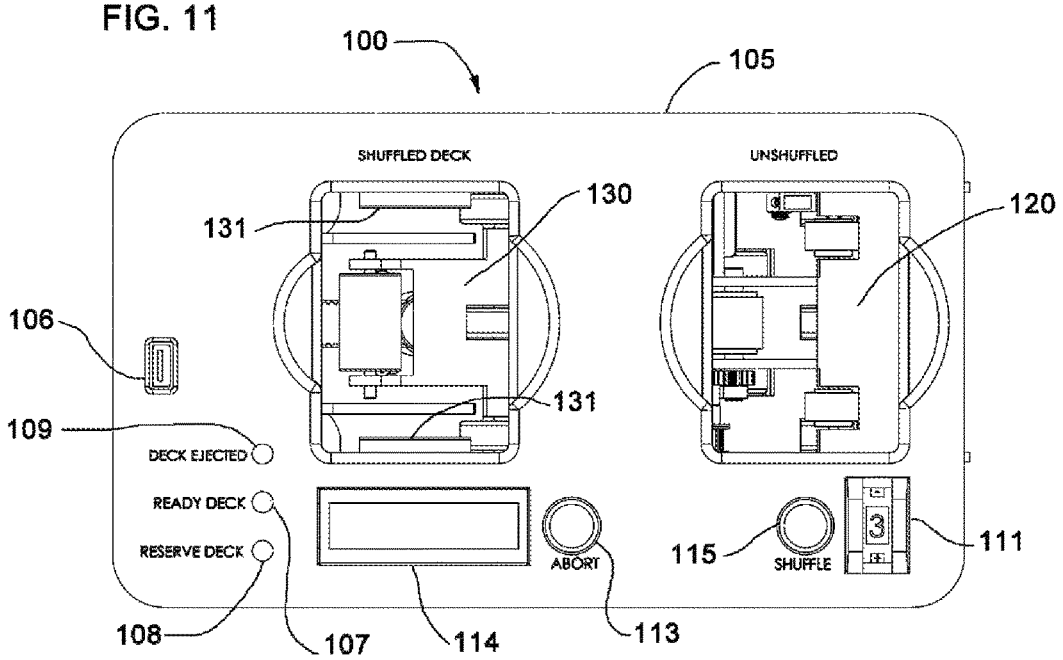
FIG. 11 is a view of the console control panel of the apparatus in FIG. 9, as viewed by the dealer.

FIG. 11 shows the control console 105 and its controls as viewed from above by a dealer. The control console 105 includes various indicators and buttons 107, 108, 109, 114, 113, 115, 111 used to control the apparatus 100. A "push switch" 111 is located at the lower right of the console and is used to set the "mode" of the card handling apparatus 100. The "mode" establishes the parameters for different card games or different activities. For example, "MODE 3" might be the mode for establishing the parameters for a blackjack game which instructs the apparatus that each deck must possess 52 cards, no jokers, and that each deck must be randomized. As another example, "MODE 4" might be a mode that instructs the machine to process a deck to verify the integrity of a 52 card deck without randomizing. The digit display on a "push switch" is incremented by pushing either the plus or minus button which reside above and below the digit display of the push switch 111.

The control console 105 additionally possesses a SHUFFLE button 115 which is used by the dealer to commence operation of the apparatus, and an ABORT button 113 which is used to stop the operation of the apparatus in the case of a failure. A 2×16 character display 114 displays fault messages to the dealer. Examples of such display messages are "READY DECK IS VERIFIED", or "DECK REJECTED-TOO MANY SPADES".

The control console 105 additionally possesses three status LED's 108, 107 and 109 that indicate the status of the card decks being internally processed by the apparatus 100. The indicators 107 and 108 are bi-color LED's which may show either red or green lighting, but other colors can be used. A green light indicates that a given deck is verified, randomized and ready for play, while a red light indicates when a particular deck position is vacant. The "Deck Ejected" indicator 109 is activated with red flashing color when the apparatus 100 ejects a faulty card deck, thus alerting the dealer to insert a new card deck. The indicator 109 will remain flashing until the dealer inserts a new card deck into the card deck intake portal 120. Although not shown, the processed card discharge portal 130 may have a hinged cover (not shown) to prevent viewability of the cards contained within that cavity.

A microcontroller operates in concert with a "Real Time Clock" (RTC) and segments of memory to record the exact time of certain sensor-activated events. RTC's are used to timestamp events in six timing parameters including year, month, day, hour, minutes and seconds. A commonly utilized RTC is for example model DS1307 made by Dallas Semiconductor Corporation. The RTC is used to timestamp the insertion of card decks into the card deck intake portal 120, the delivery of verified card decks to the card deck discharge portal 130, the delivery of verified card decks to the reserve position, and the delivery of faulty card decks to discharge port 140. In the case of the faulty deck rejections, the microcontroller will additionally record a reason for rejection along with a timestamp. The console 105 possesses a USB port 106 that may be used to download the timestamped data from memory of the apparatus 100. Alternatively, the apparatus 100 may be networked to a central computing device in the casino that can periodically or continually (in real time) download the timestamped data associated with rejected card decks. The network connection may be used to monitor activity and performance characteristics of the apparatus from a remote location, as is known in the art.

Figure 12:
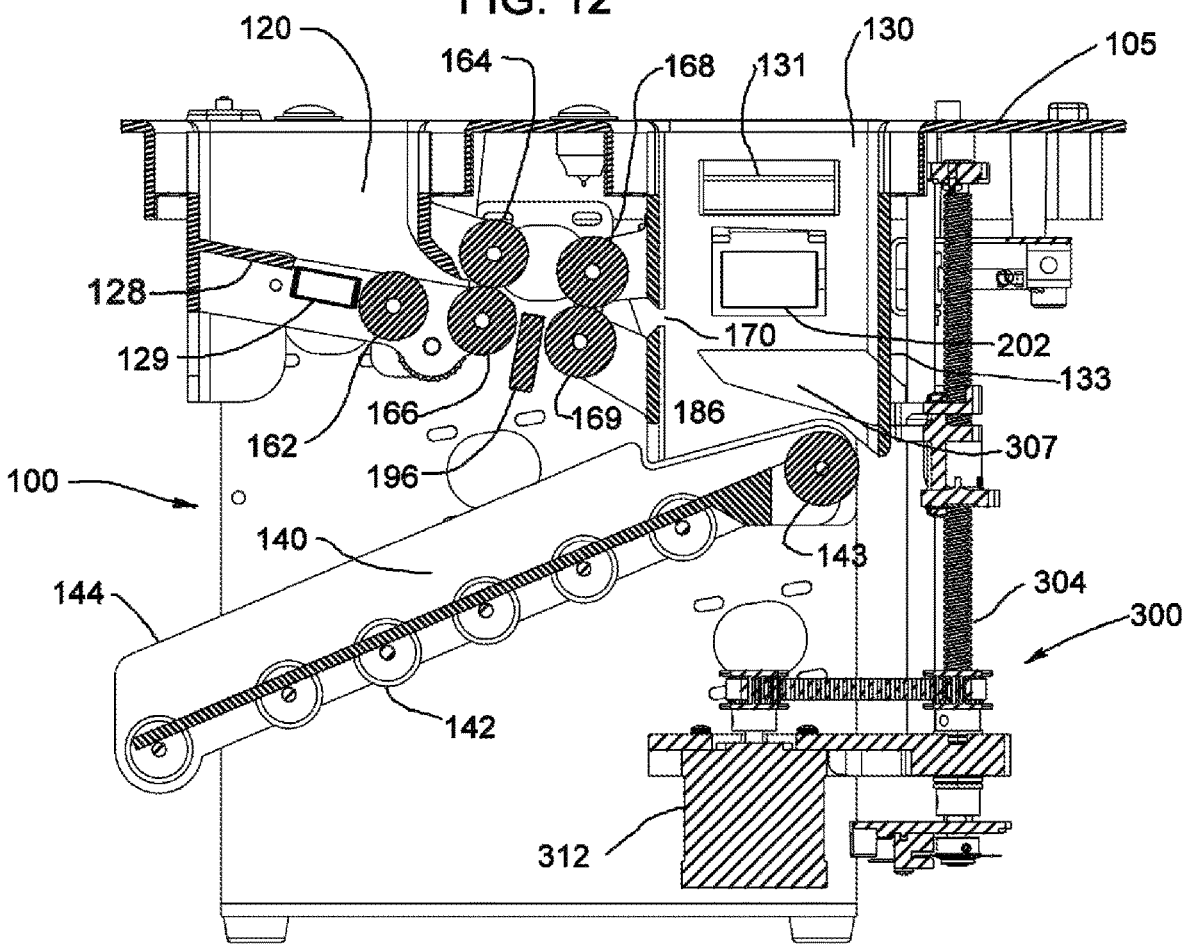
FIG. 12 is a side elevational section view of the apparatus herein showing the internal chambers with no cards present.

The anatomy of the apparatus 100 is briefly explained by the section view shown in FIG. 12 which is devoid of any card decks or stacks. This view is looking into the apparatus from the side of the casino table players. The card deck intake portal 120 is shown near the top left of the view. Cards are supported in the portal 120 by shelf 128 and roller 162 which are located at the base of the portal. Feed rolls 162, 166 and 164 are utilized to move individual cards from portal 120 and past an optical recognition sensor 196, and additional feed rolls 168 and 169 move individual cards into the randomizer chamber 186. The housing 133 possess four walls which contain card decks with slight clearance around the periphery, thus forming the randomizing chamber 186. After the deck is randomized and successfully verified, an elevator assembly 300 lifts the processed deck to a retractable support structure 131 which is located in the card deck discharge portal 130. In the event that a card deck is found to be faulty after interrogation in the randomizing chamber 186, the microcontroller lowers that card deck to a transfer roll 143 which removes the card deck from the elevator arms 307 and sends the faulty deck to discharge port 140. Freely rotatable rollers 142 in the discharge port 140 allow the faulty deck to be discharged from the apparatus 100 by gravity. The apparatus 100 may be used to optically interrogate (verify) card decks without utilizing the randomization cycle, as described by the function of the mode switch 111 setting above.

Figure 13A:
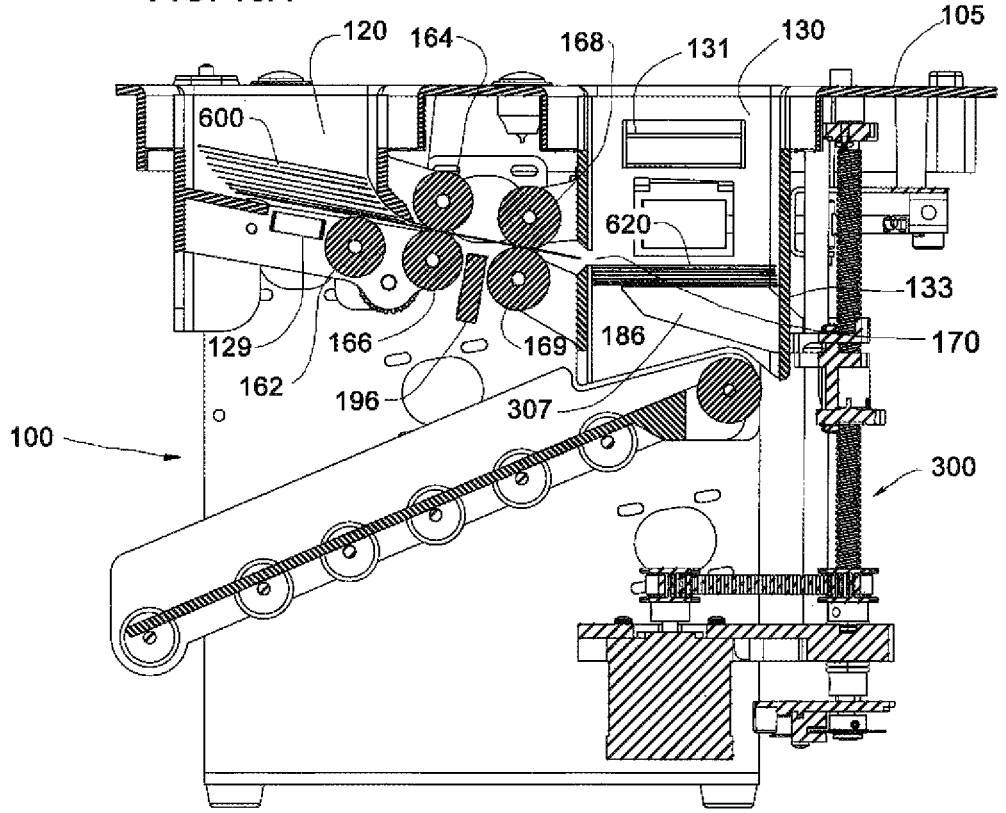
Figure 13B:
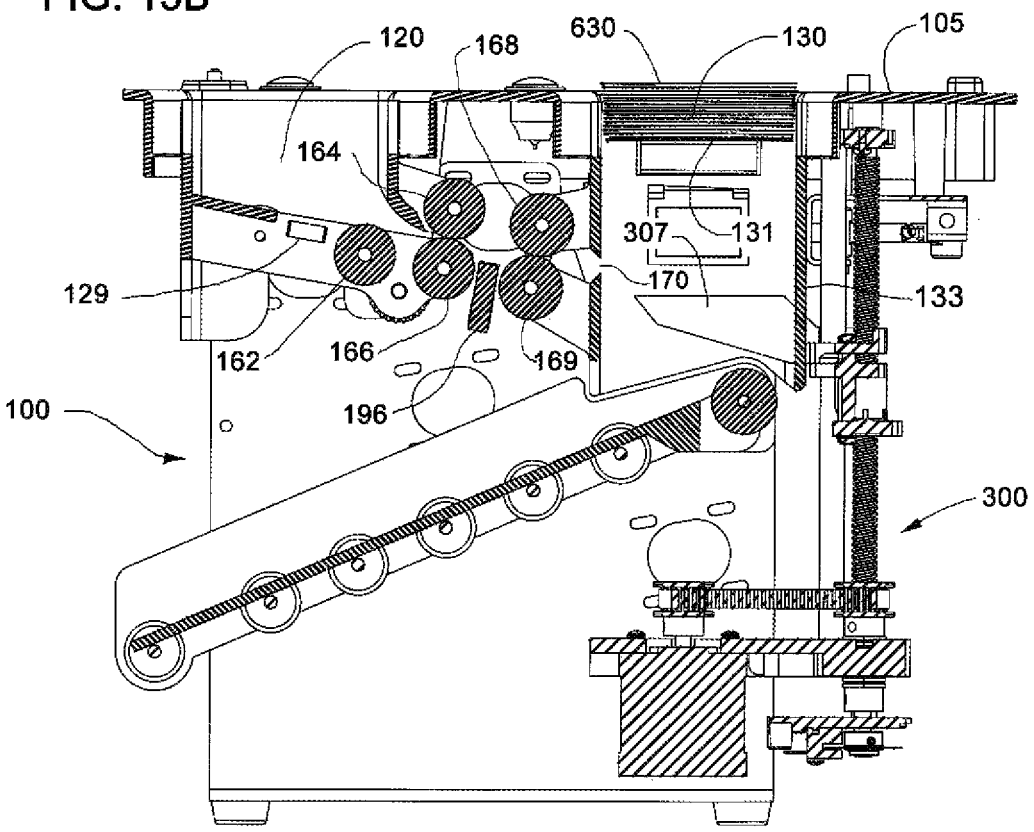

A more detailed explanation can be observed from FIGS. 13A, 13B and 13C, which explain the movement of a single card deck within and through the card handling apparatus 100. FIG. 13A shows a new or spent deck 600 (unshuffled) located in the card deck intake portal 120. When the dealer activates the SHUFFLE button 115, the microcontroller interrogates sensor 129 to determine if any card is present in the card intake portal 120. If a card is detected by the sensor 129, the microcontroller will activate motors (not shown) that rotate feed rolls 162, 166 and 164 until the leading edge of a card is detected by optical recognition sensor 196.

In FIG. 13A, an unshuffled card of a card deck 600 is moved past the optical recognition sensor 196 and into the randomizing chamber 186, where the card stack 620 is supported by elevator arms 307 of the elevator assembly 300. The microcontroller activates a motor (not shown) to rotate feed rolls 168 and 169 which feed the cards of the card stack 620 into the randomizing chamber 186 through a slot 170 in the housing 133. The optical recognition sensor 196 is utilized to read the rank and suit of each card, in addition to counting the cards in the deck. The sensor 196 may be any optical recognition sensor as taught in the prior art, including a digital camera, CMOS camera, color pixel sensor or a CCD image sensor. In the preferred embodiment, the sensor 196 is a color pixel sensor and is used to read the rank and suit in the upper right corner of each card. This optical recognition process will continue until sensor 129 signals that no more cards are available in the card intake portal 120. Upon completion of the deck insertion into the randomizing chamber 186, the microcontroller will determine if any fault condition exists, including card shortages, extra cards, flipped cards or unreadable cards.

After the randomizing cycle is completed, the microcontroller decides if a card deck is faulty. If the card deck is not faulty, and no card deck resides in the "reserve deck" position, the elevator arms 307 will raise the randomized (shuffled) card deck 630 to the processed deck discharge portal 130 as shown in FIG. 13B, and transfer the card deck 630 to the retractable support structure 131. A first processed card deck placed into this position upon the retractable support structure 131 is designated as the "ready deck". The indicator LED 107 on the control console 105 will be activated to indicate that a verified card deck resides in the portal 130. As shown in the FIG. 13B, the elevator arms 307 will then relocate within the randomizer chamber 186 such that another unshuffled deck can be processed while the "ready deck" is available in the card deck discharge portal 130. Conversely, if the microcontroller has decided that the randomized deck is faulty, then it will lower the elevator arms 307 and discharge that faulty deck through discharge portal 140.

Figure 30:
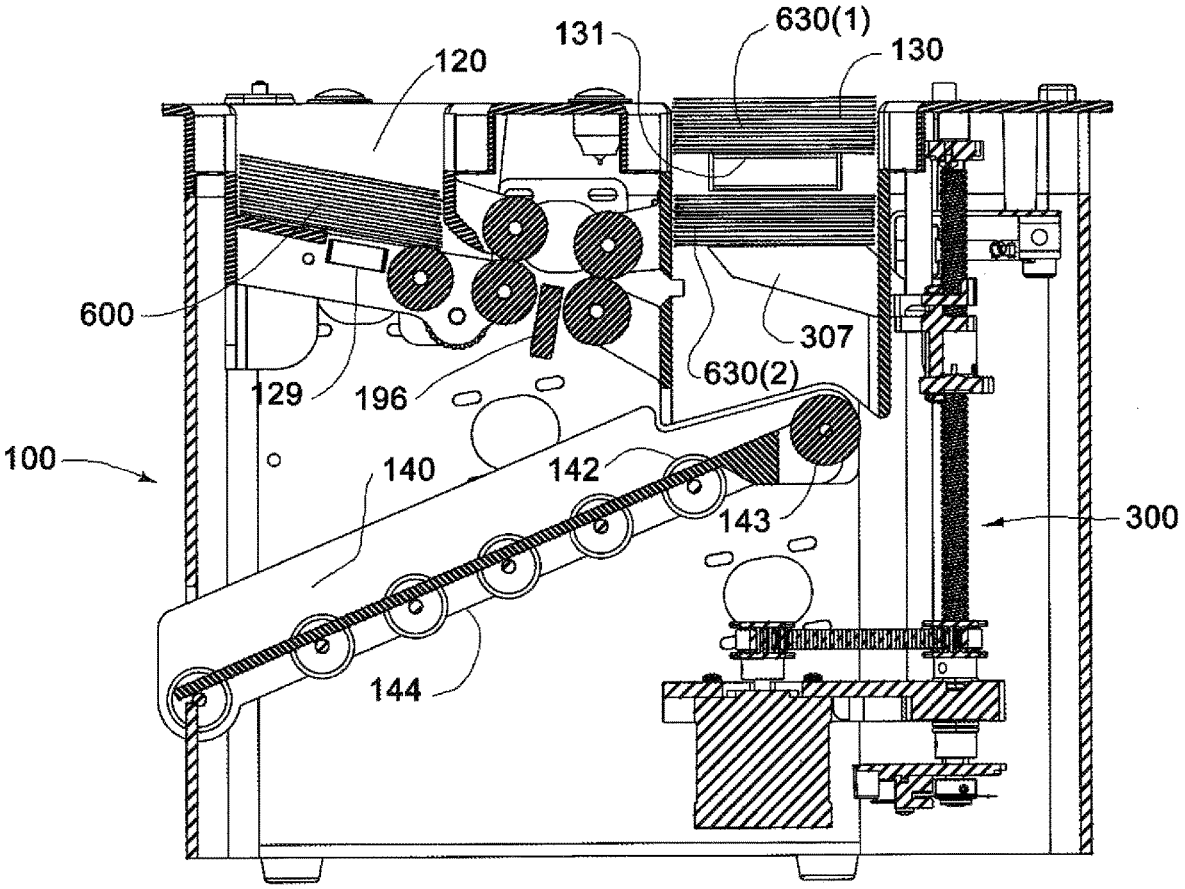
FIG. 30 shows a section view of the apparatus whereupon a first "ready deck" is positioned in the first discharge portal and a second "reserve deck" is positioned in its footprint while both are verified and ready for game table play. A third unshuffled deck is awaiting randomization while positioned in the card deck intake portal.

If the card deck discharge portal 130 is occupied after verifying a first "non-faulty" card deck, then the microcontroller will raise the elevator arms 307 with the second "non-faulty" card deck to the "reserve deck" position as shown by label 630(2) in FIG. 30. The microcontroller utilizes the encoder count register to establish the "ready deck" position just below, and within the footprint of the card deck discharge portal 130.

FIG. 13C illustrates the case in which the microcontroller has determined that a card deck is faulty and lowered the elevator arms 307 to a position below the transfer roll 143. The forked shape of the elevator arms 307 allows the elevator arms 307 to pass by and below the freely rotatable transfer roll 143 and the adjoining roll 142. Those two rolls 142, 143 take support of the faulty card deck 610 and allow gravity to discharge that deck 610 in the direction of the arrow along sloped discharge port 140. It is noted that in this figure, the elevator arms 307 have passed below the discharge roller 143 and the faulty card deck 610 has just begun to move along the discharge rollers 142 of the discharge port 140.

The randomizing cycle comprises a series of motions performed by the apparatus to sort the individual cards into a randomly arranged deck within the chamber 186. The randomizing cycle will automatically start when the dealer activates the "Shuffle" command button 112 as shown in FIG. 10, as long as sensor 129 detects the presence of a card. Referring to FIG. 13A, a series of feed rolls 162, 166, and 164 strip the bottom card from the stack of cards 600 and move that card past the optical recognition sensor 196. The optical recognition sensor 196 acts in concert with the microcontroller to count each card, and to identify the rank and suit of each card which passes between feed roll 166 and feed roll 169. Feed rolls 168 and 169 then inject each card into the randomizer chamber 186, whereupon each card is inserted into a growing card stack 620.

The randomizing chamber 186 possesses an elevator surface comprising elevator arms 307 which support the card stack 620 during randomization, and move the card stack 620 with oscillation motion in a direction parallel to the walls within the randomizing chamber 186 (FIG. 13A). The structure of the elevator assembly 300 and its driving means is shown in FIG. 14. The elevator assembly 300 has two fork-shaped arms 307, which are moved vertically by motion of a lead screw 304. Each elevator arm 307 possesses a support surface for supporting card stacks as identified by labels 307A and 307B. Guide shafts 324 and 322 prevent torsional movement of the elevator arms 307, and are attached to platform 318 to which a stepper motor 312 is mounted. The upper portion of elevator assembly 300 is stabilized by bridge 320. The stepper motor 312 rotates the lead screw 304 by means of a timing belt 308. The orientation of a card stack 620 is shown when in transit on the elevator in FIG. 15. As shown in FIG. 13A, the two elevator arms 307 of the elevator penetrate the randomizer chamber 186 through access slots 835 (see FIG. 22) in the wall 133 of the randomizing chamber 186, such that the elevator arms 307 may move freely in a direction parallel to the chamber walls. At the same time, the card stack on the elevator arms 307 is constrained on four sides by the chamber walls 133A, 133B, 133C and 133D of randomizing chamber 186 (see FIG. 22).

Figure 28:
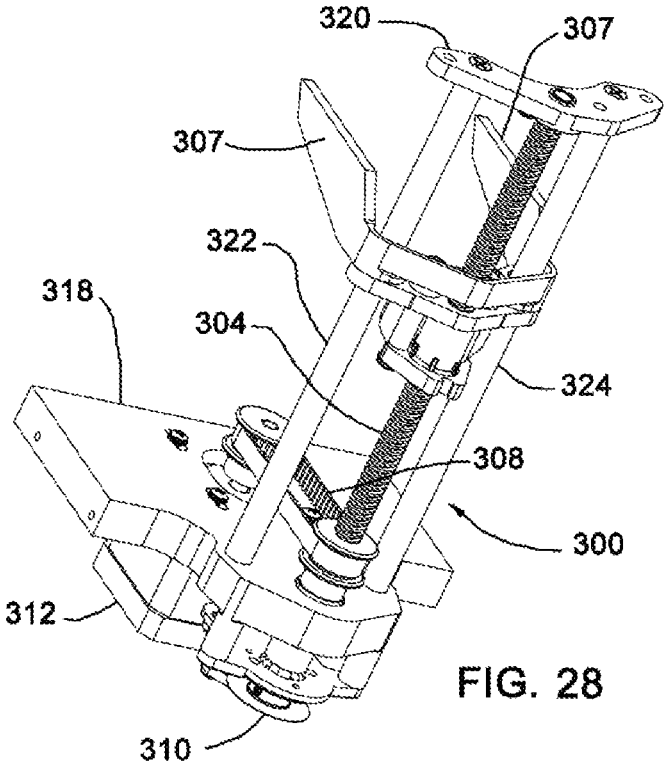
FIG. 28 shows an isometric view of the elevator with its incremental encoder.

The elevator movement is controlled in very fine increments by the stepper motor 312 in conjunction with an incremental encoder 310 which is mounted to the lead screw 304 as shown in FIG. 28. An encoder disc of the incremental encoder 310 has 200 increments per revolution which corresponds to each step of a 200 step per revolution step motor. The ratio of the lead screw 304 rotation to the elevator arm 307 linear motion is 4 millimeters per revolution. The stepper motor 310 can therefore control the elevator arms 307 in linear increments of 20 microns, where 1 micron equals one-millionth of a meter. The thickness of a typical playing card is approximately 300 microns. Thus, the stepper motor can move the elevator arms 307 with the precision of 1/15th of the card thickness. In other words, 15 motor steps moves the elevator arms 307 one card thickness. This high ratio makes the elevator mechanism controllable in fine increments, thus intolerant to positional error. Rather than the incremental encoder 310, other types of sensors could be used to monitor the linear movement of the elevator, as is known and practiced in the art.

Figure 8A:
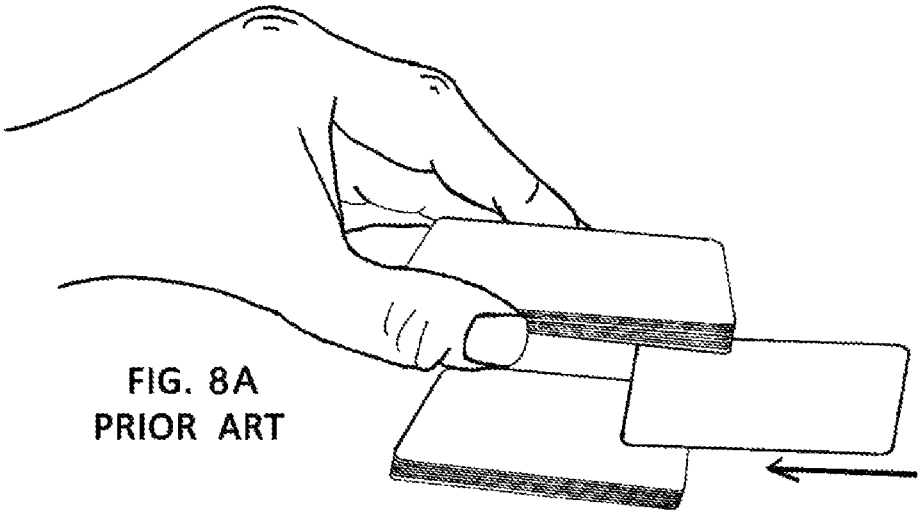
FIG. 8A PRIOR ART
FIG. 8A illustrates the insertion of a "cut card" into a card stack by a dealer, which is emulated by the mechanical gripper mechanism of FIG. 7.
Figure 8B:
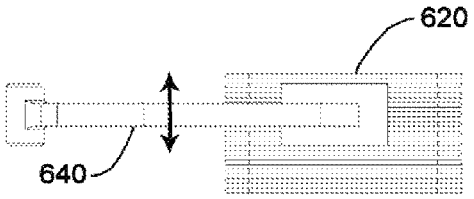
FIG. 8B PRIOR ART
FIGS. 8B, 8C, 8D and 8E compare two prior art randomizing methods.
Figure 8C:
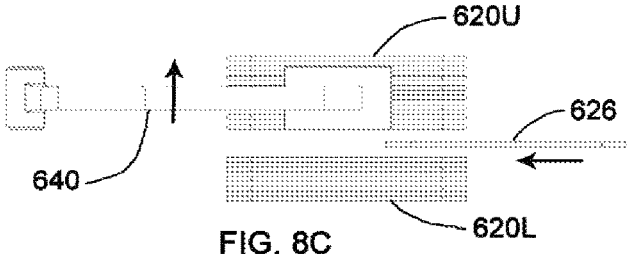
FIG. 8C PRIOR ART
Figure 8D:
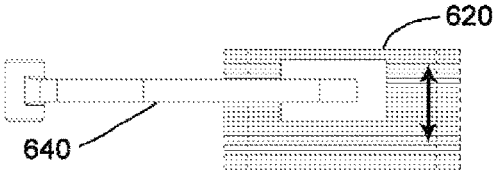
FIG. 8D PRIOR ART
Figure 8E:
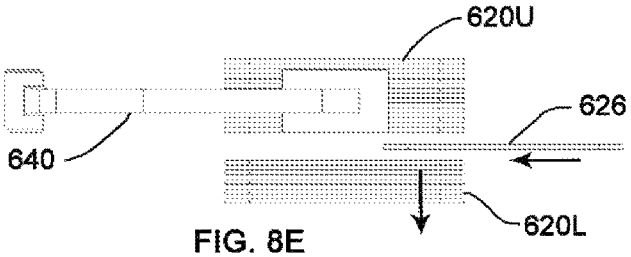
FIG. 8E PRIOR ART

The randomizing method emulates the motion of a human dealer when cutting a card into a card deck as shown in FIG. 8A. A gripper portion of the gripper assembly 200 (FIG. 16) is shown in FIG. 17. Two gripper pads 202 are mounted on the terminal ends of a first gripper arm 203 and a second gripper arm 204, with each pivoting upon pivot screws 206. The two arms are actuated by two small solenoids 207 and 208 which are mounted on the gripper frame 210. When the solenoids are activated, the arms 203, 204 and their associated pads 202 move in the direction of the arrows to pinch the lateral surfaces of a card stack as shown in FIG. 18. Upon deactivation of the solenoids 207, 208, the two arms 203, 204 are moved in the reverse direction by spring 212, which relaxes the grip and releases the card stack 620. In the relaxed position, there exists only slight clearance between the gripper pads 202 and the lateral surface of card stack 620.

Figure 19:
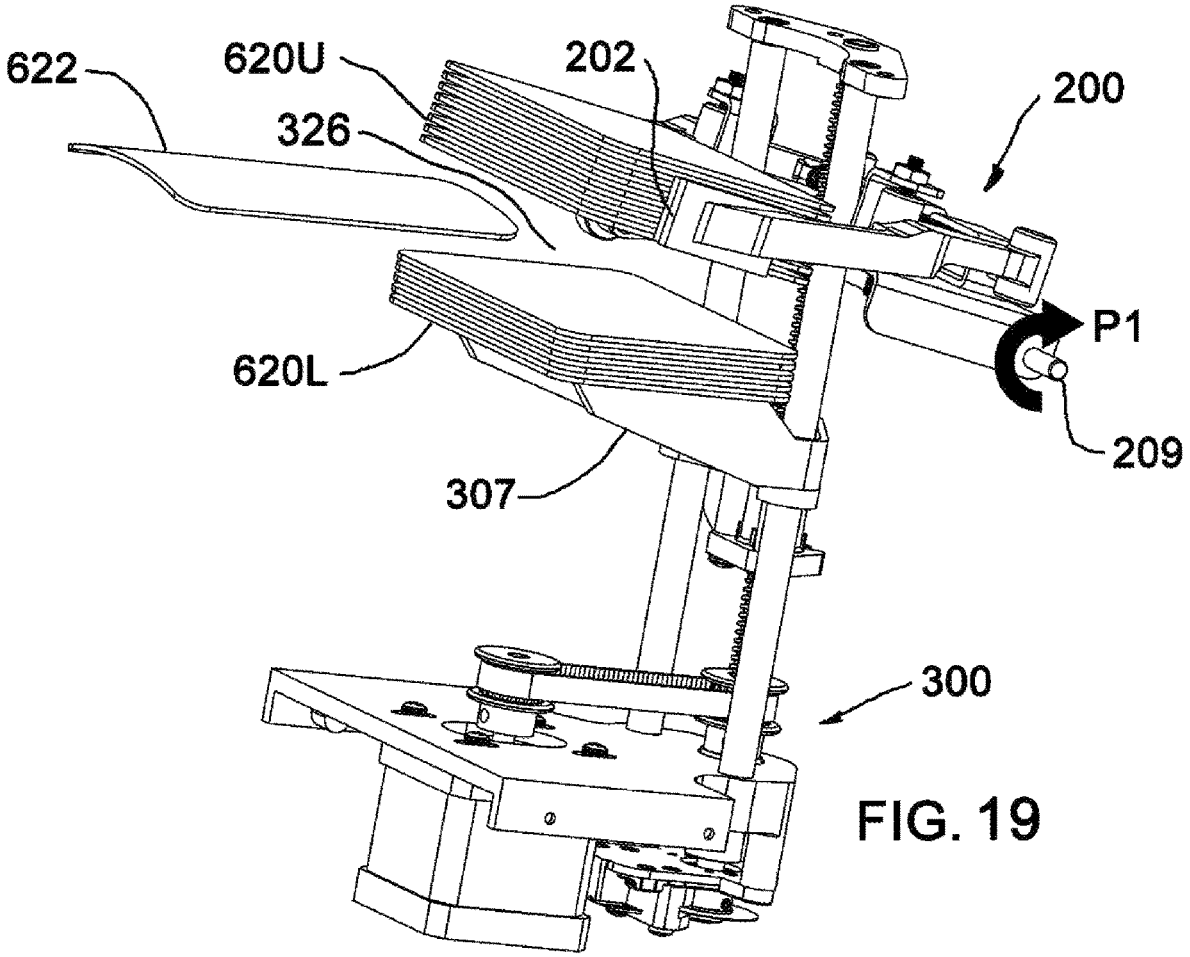
FIG. 19 is an isometric view of the gripper mechanism creating a random wedge-shaped opening between two sub-stacks of cards.

The complete gripper assembly 200 is shown in FIG. 16 where the gripper assembly 200 is pivotally mounted on a shaft 209. The pivotal mount allows the gripper frame 210, including gripper arms 203 and 204, to move in an arc after the gripper solenoids 207, 208 have been activated. A cam follower roll 222 is mounted to the follower mount 218 which is rigidly attached to the gripper frame 210. During the gripping cycle, at least one card of the card stack 620 is grasped by the gripper arms 203 and 204, and thereafter lifted by the cam 220 to move an upper sub-stack of cards 620U upward through an arc. The motion is illustrated in FIG. 19 where the upper sub-stack is shown as 620U.

Figure 20:
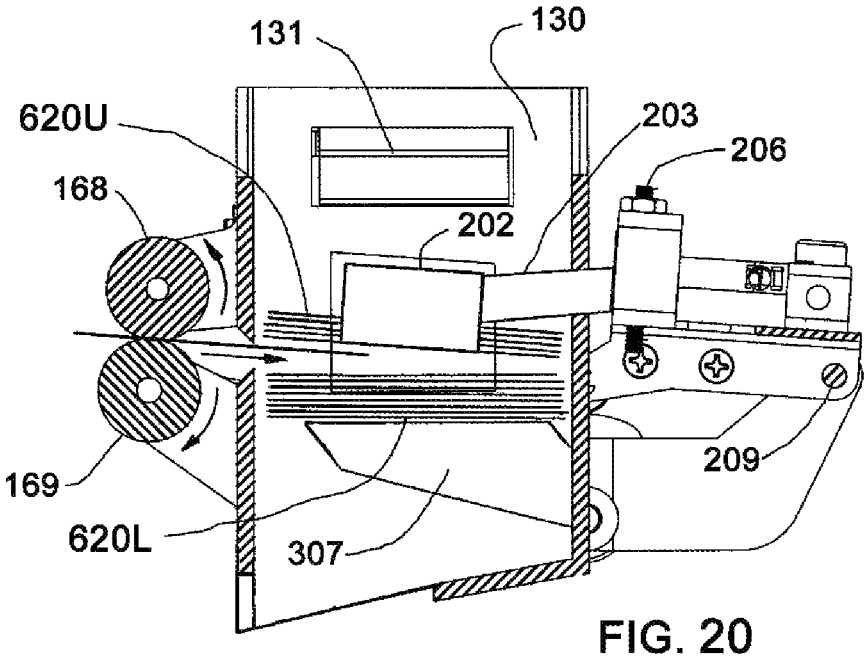
FIG. 20 is a cutaway side view of the randomizing apparatus showing a card being inserted into a randomly-created wedge-shaped opening in the receiving card stack.
Figure 21:
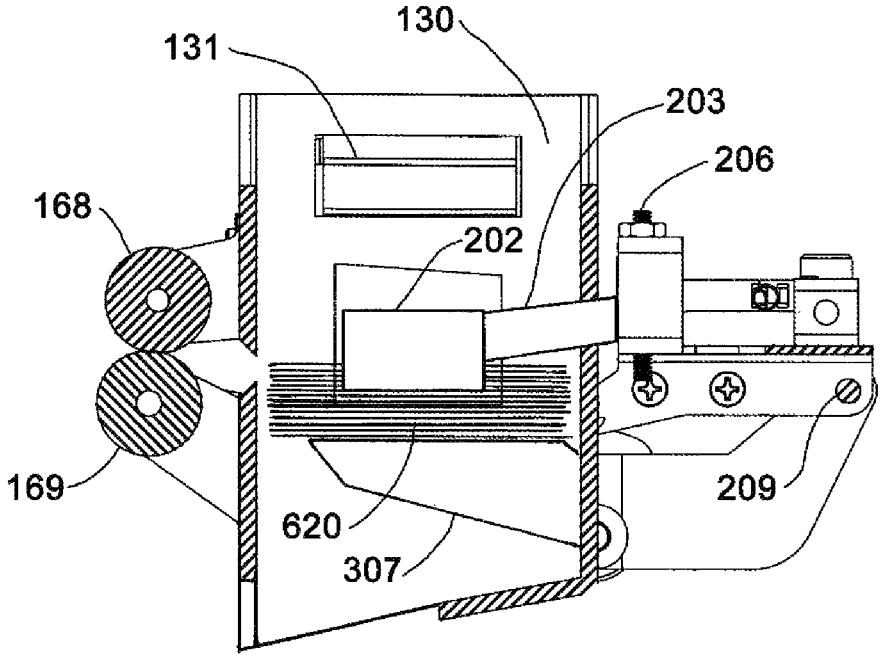
FIG. 21 is a side elevational section view of the randomizing apparatus showing the receiving card stack after the upper sub-stack has been lowered onto the newly inserted card by the gripper mechanism.

The elevator assembly 300 is used to position a card stack relative to the gripper mechanism 200, in order to allow the gripper assembly 200 to split the card stack into two sub-stacks, 620U, 620L. The orientation between the elevated, upper sub-stack 620U, the gripper assembly 200, the lower sub-stack 620L, and the elevator assembly 300 is shown in FIG. 19. A lower card sub-stack 620L is shown supported by the elevator arms 307, while an upper card sub-stack 620U is shown lifted in an arc about pivot P1 which is locationally fixed to the frame of apparatus 100. The vertical position of the split between the upper sub-stack 620U and the lower sub-stack 620L is determined by the microcontroller which relocates the elevator arms 307 just prior to the gripping cycle. As shown in FIG. 19 and FIG. 20, the elevator arms 307 position a card stack 620 in a randomly selected elevation and the gripper assembly 200 thereafter splits the card stack through an arc at that random location. The lower sub-stack 620L is held stationary by the elevator arms 307 while the gripper arms 203, 204 raises the upper sub-stack 620U, and while a new card 622 is inserted into the wedge-shaped opening 326. As illustrated in FIG. 19, the axis of the elevator may form an angle with the surface of the casino table that is other than perpendicular.

Figure 4:
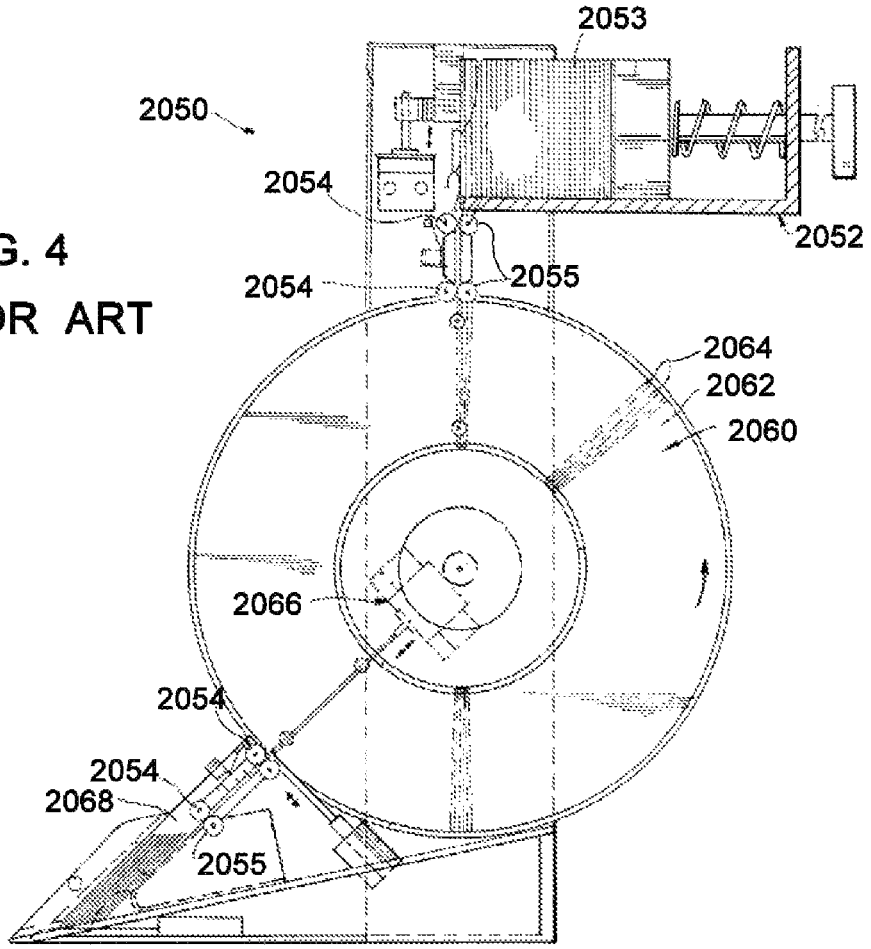
FIG. 4 PRIOR ART
FIG. 4 illustrates a classic prior art shuffling machine which unloads cards from an unshuffled deck into the individual slots of a carousel, randomly rotates the carousel, and then unloads cards from a randomly-chosen slot and into a discharge portal.
Figure 5:
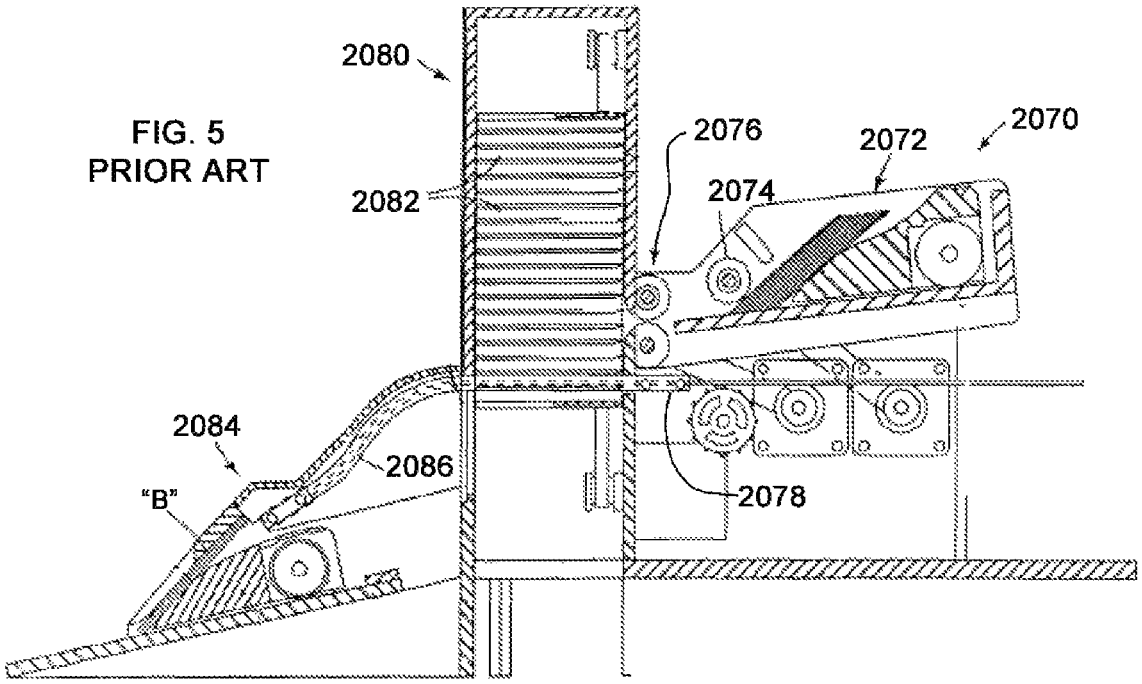
FIG. 5 PRIOR ART
FIG. 5 illustrates a similar prior art shuffling machine which unloads cards from an unshuffled deck into the individual slots of a vertical rack, randomly elevates the vertical rack, and then unloads cards from a randomly-chosen slot and into a discharge portal.
Figure 6:
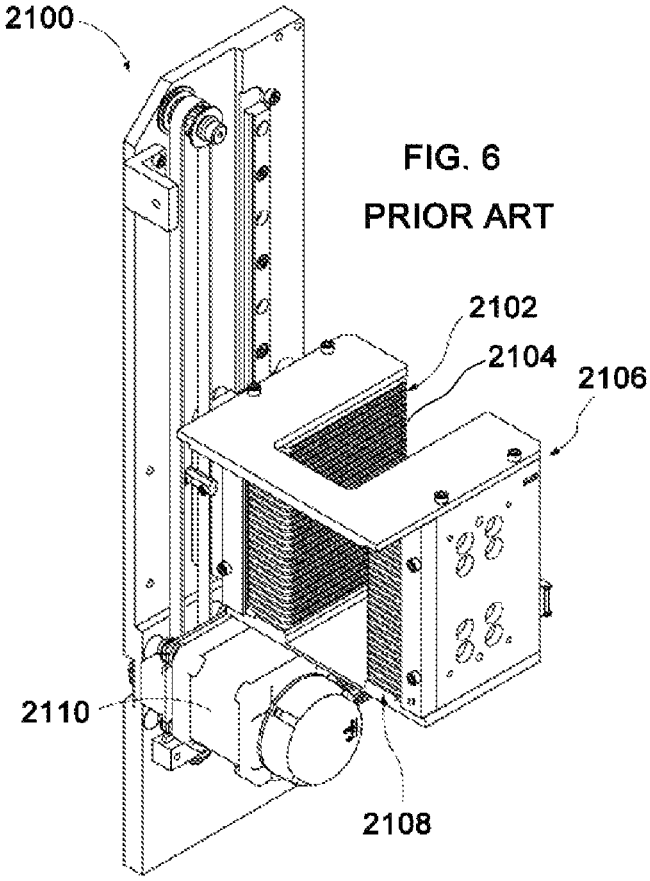
FIG. 6 PRIOR ART
FIG. 6 illustrates a prior art randomizing mechanism which utilizes a vertically moving comb with narrow card slots.
Figure 7:
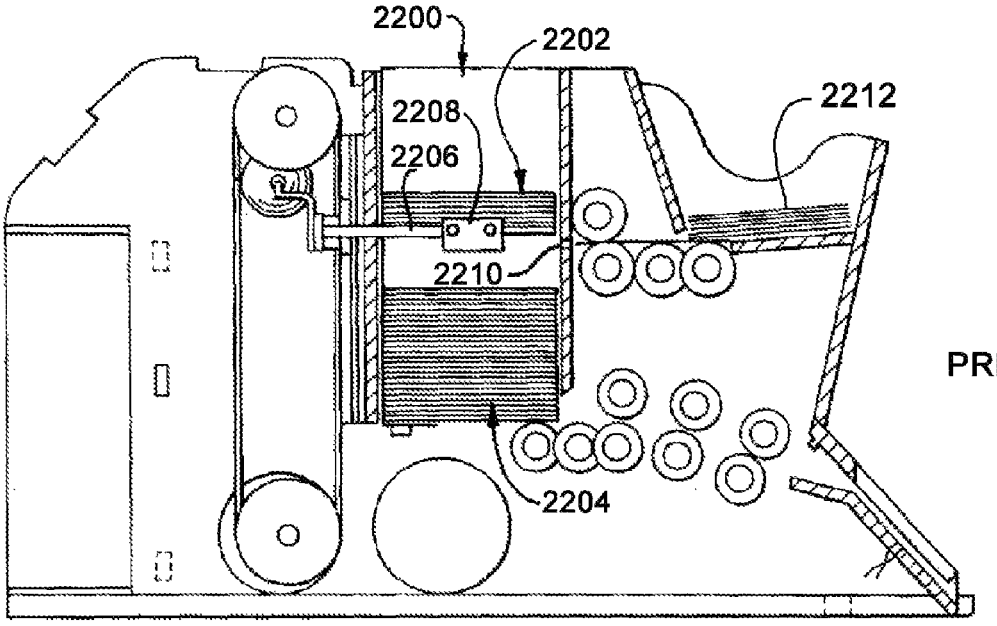
FIG. 7 PRIOR ART
FIG. 7 illustrates a prior art randomizing mechanism which utilizes a mechanical gripper to separate a card stack at random positions, thus enabling the insertion of an individual card which is being moved from an intake portal.

The purpose of the cam 220 is two-fold. First, the gripper assembly 200 creates a large wedge-shaped opening 326 which is tolerant to curved or bent cards as illustrated by warped card 622 in FIG. 19. The large wedge-shaped opening 326 overcomes the jamming problem exhibited by prior art narrow slot carousel and moving comb shuffling devices shown in FIG. 4, FIG. 5 and FIG. 6. Secondly, the cam 220 is designed to alleviate the cyclic life burden on the components of the elevator assembly 300. The prior art devices that utilized gripper mechanisms (see prior art FIGS. 8B-8E) required three elevator motions for each card insertion; a first elevator motion to arrive at the splitting plane; a second elevator motion to split the deck into two sub-stacks; and a third elevator motion to merge the two sub-stacks together after each card insertion. For one deck of 52 cards, for example, the prior art elevators must shuttle through 156 (3×52) motion cycles. In contrast, the elevator assembly 300 of an embodiment of the present invention herein relocates just once during each card insertion cycle, thereby extending the service life of the elevator assembly 300 as compared to the prior art.

The previously described grasp-elevate-insert-release cycle is repeated for each of the cards in an unshuffled deck until all cards have been transferred to the card stack 620 in the randomizing chamber 186. The card stack 620 thus begins with one card and builds to a full deck of 52 cards in the case that 52 cards is the desired deck size. Each new card is inserted into the card stack 620 at randomly-chosen elevator positions by the microcontroller, which utilizes a depletion algorithm to determine a plane between two adjacent cards within the receiving card stack 620.

The depletion algorithm is based upon a physically-generated index that is derived from the optical recognition sensor 196. That optical recognition sensor 196 detects the trailing edge of each card and increments a count that indicates the number of cards that have been depleted from the card intake portal 120. The depletion count is a physically detected index that is used by the randomizing algorithm. The algorithm can be expressed as equation 1.1:

$$P=\text{RAND}[1 \text{ to } D] \tag{1.1}$$

Where:

P=the elevated insertion plane, and

D=the depletion number of the card being inserted, and

RAND[1 to D] is a random number from within the range between 1 and D

Figure 29A:
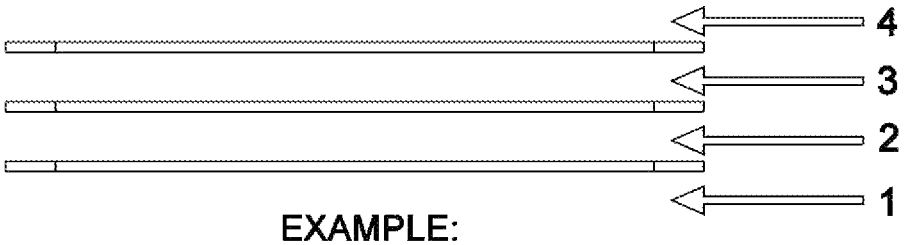
FIGS. 29A and 29B show two exemplary illustrations of the receiving card stack numbering sequence utilized by the randomizing method.
Figure 29B:
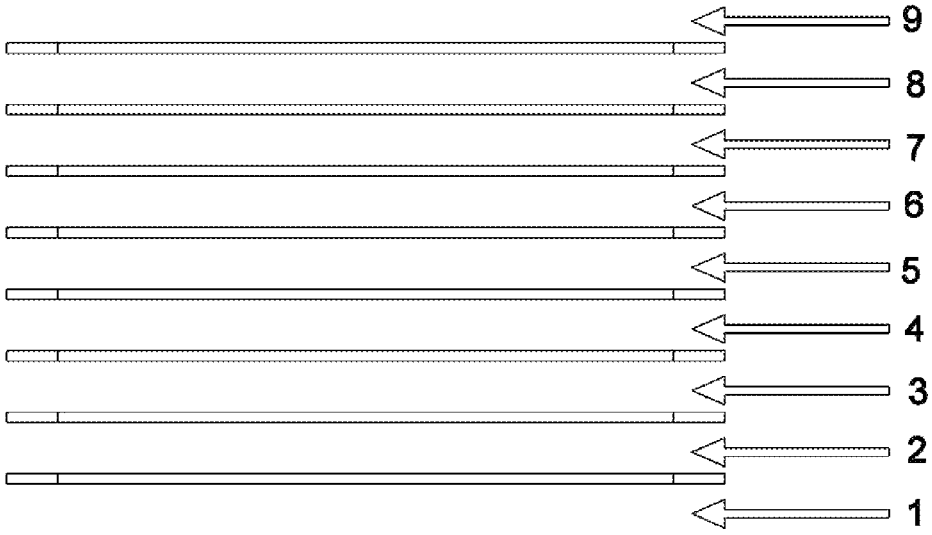

Equation 1.1 can be understood and appreciated from viewing the examples in FIG. 29A and FIG. 29B where the numbered arrows indicate optional plane locations within a card stack. In FIG. 29A, the depleted card number is 4, which means that this is the 4th card to be removed (depleted) from the unshuffled card stack residing in the intake portal. The microcontroller will choose a plane in real time for inserting that 4th card into the previous 3-card stack, by generating a random number in the range of 1 to 4, where the bottom of the stack is always designated as plane number 1. In other words, the microcontroller randomly chooses one of four available planes for the insertion in real time. The elevator assembly 300 then positions the stack precisely such that the gripper pads 202 can create the wedge-shaped opening 326 at the chosen plane. The card is thereafter inserted into the wedge-shaped opening 326.

In FIG. 29B, the depleted card number is 9, which means that this is the 9th card to be removed (depleted) from the unshuffled card stack. The microcontroller will choose a plane in real time for inserting that 9th card into the previous 8-card stack, by generating a random number in the range of 1 to 9, where the bottom of the stack is always designated as plane number 1. In other words, the microcontroller randomly chooses one of nine available planes for the insertion. The elevator then positions the stack precisely such that the gripper pads 202 can create the wedge-shaped split at the chosen plane, insert a new card, and thereafter lower than the upper sub-stack 620U onto the newly inserted card. In this way, the randomized stack is incrementally constructed.

There is no preconceived boundary for the randomizing algorithm of equation 1.1, which depends only upon the physically detected depletion count. For example, a 65th depleted card would be randomly inserted in one of 65 randomly selected planes. This type of randomization is mathematically ideal randomization, because each and every card is randomly inserted into a growing randomly-generated card stack, until the entire deck is transformed into a randomly distributed sequence. This is in contrast to several prior art shufflers that generate a virtual random insertion sequence prior to physically moving any cards.

Figure 22:
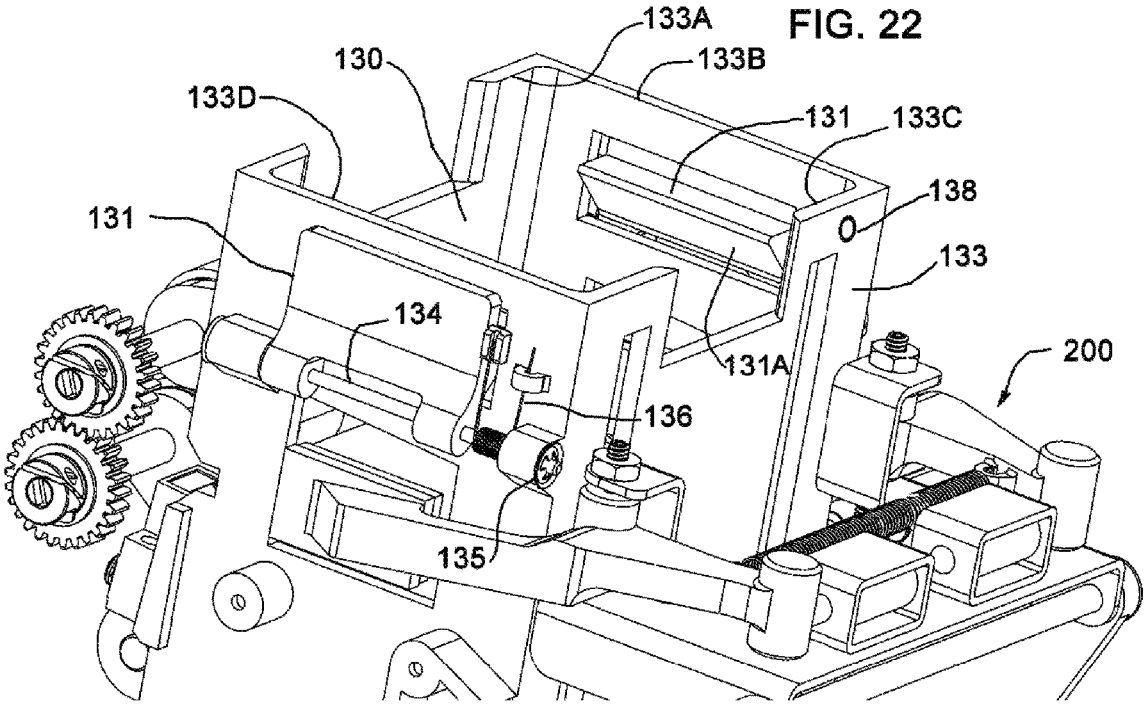
FIG. 22 is an isometric view of the retractable supports in the first deck discharge portal.
Figure 23:
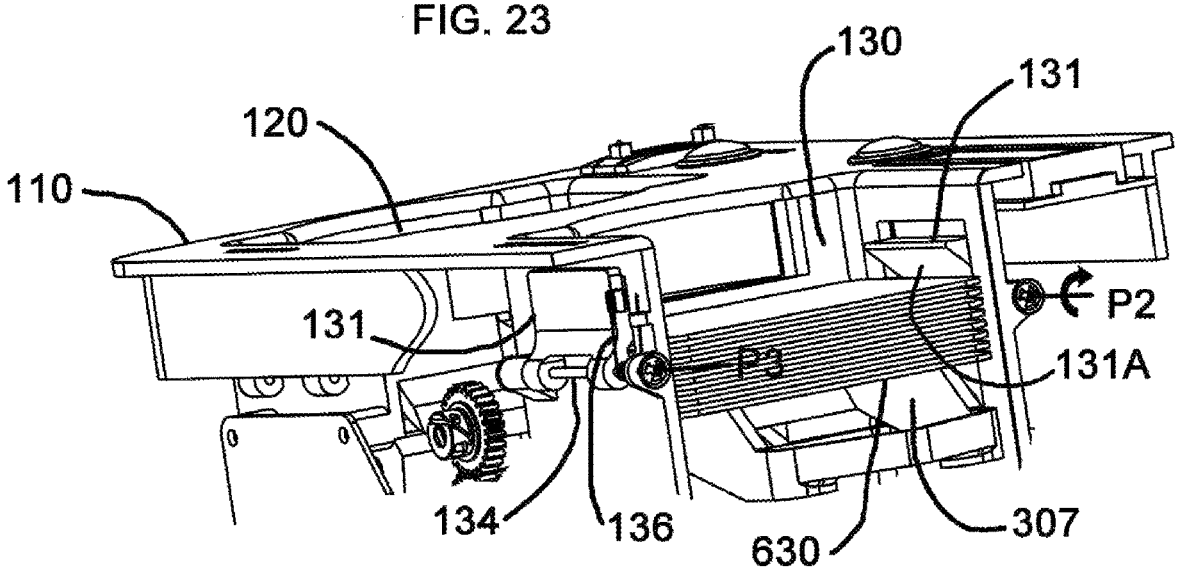
FIG. 23 is a cutaway isometric view showing the processed card stack being raised to the first deck discharge portal.

After the randomizing cycle has been completed, the elevator arms 307 raise the processed card deck 630 to the card deck discharge portal 130, where the processed card deck 630 is transferred to a retractable support structure as shown in FIG. 13B. A preferred embodiment for the retractable support structure is shown by the retractable support elements or shutters 131 in FIG. 13B, FIG. 22 and FIG. 23. Referring to FIG. 22, a pair of shutters 131 are rotatably mounted to the walls of the housing 133 and rotate upon pivot shafts 134, which are held in a supporting position by torsion springs 136. Referring to FIG. 23, the two pivot shafts 134 form axes P2 and P3, about which the shutters 131 rotate. As the elevator arms 307 raise the processed card deck 630 towards the card deck discharge portal 130, the processed card deck 630 pushes against angular surfaces 131A on the underside of the shutters 131, forcing it outward. FIG. 23 shows a cutaway oblique view of a processed card deck 630 being raised by the elevator arms 307 and located just beneath the angular surface 131*a* of shutters 131. The card deck 630 is just about to collapse the shutters 131 in this illustration.

Figure 24A:
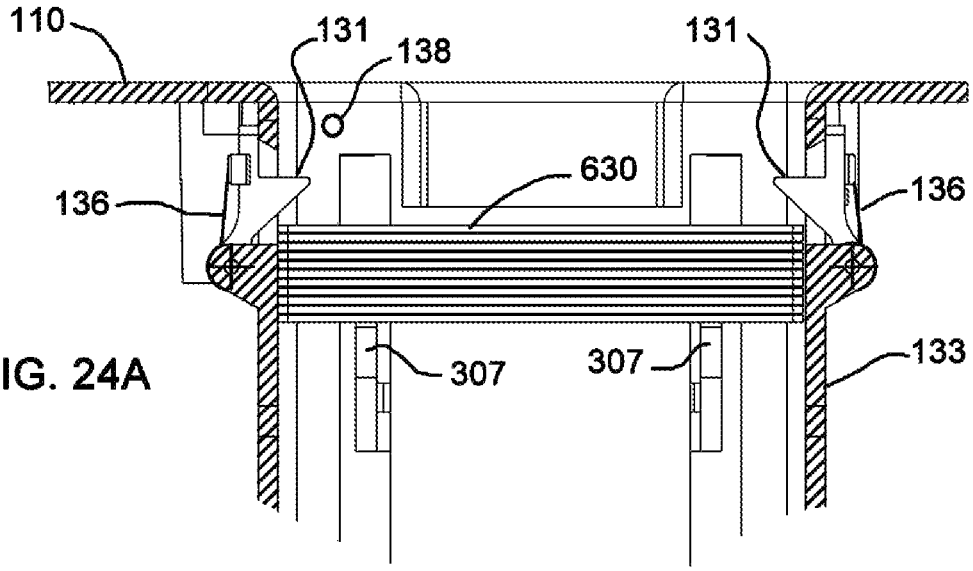
FIGS. 24A, 24B, 24C and 24D are step wise illustrations showing the sequence used to transfer a processed "non-faulty" card deck from the elevator to the retractable support structure.
Figure 24B:
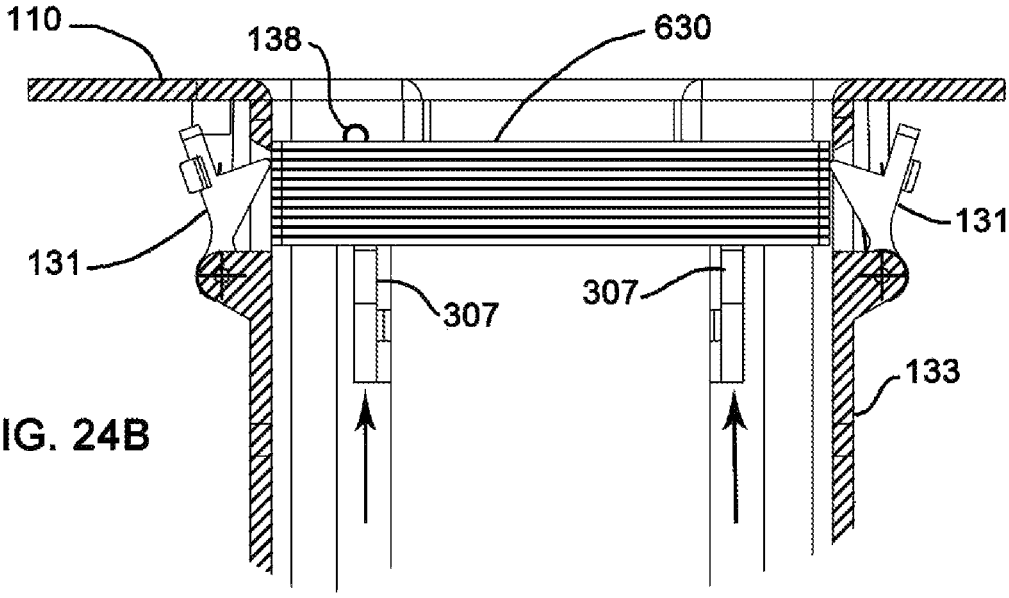
Figure 24C:
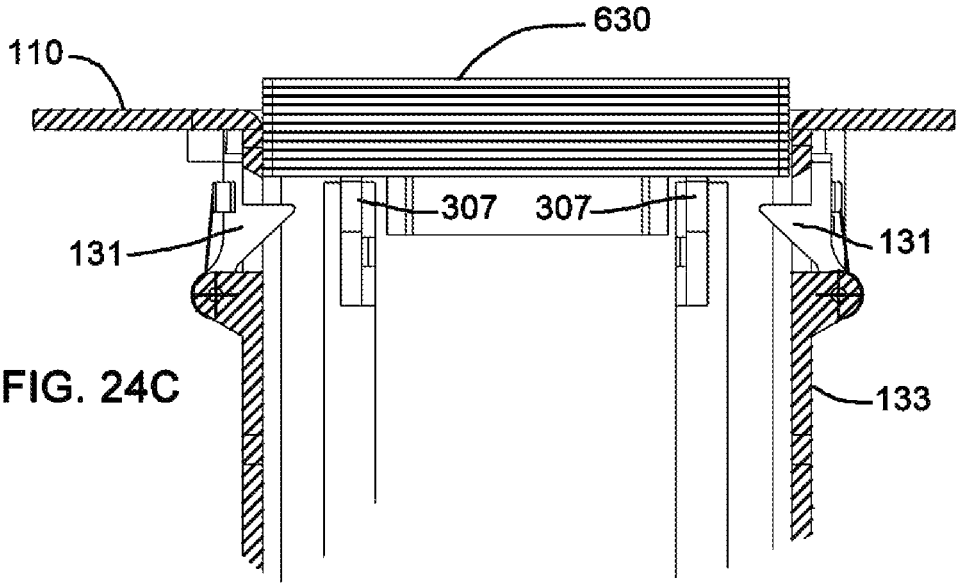
Figure 24D:
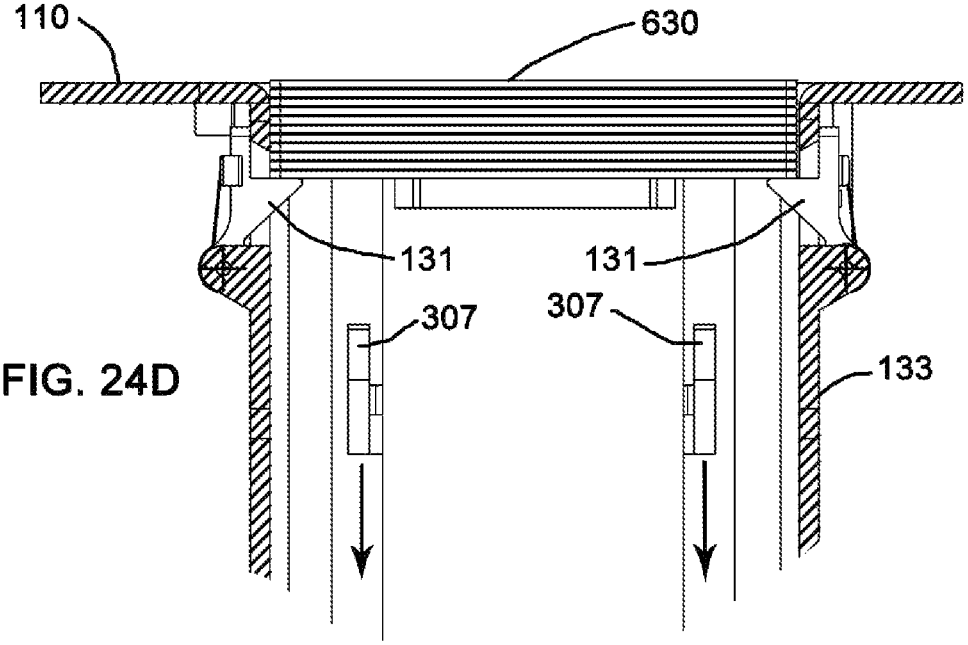

FIGS. 24A, 24B, 24C, and 24D illustrate side elevational section views which explain the sequence of collapsing the retractable support elements or shutters 131. In FIG. 24A, a "non-faulty" processed card deck 630 is shown in the "reserve deck "position and the "ready deck" has just been removed. The state change of sensor 138 signals the absence of the "ready deck" and triggers the microcontroller to examine the incremental encoder count of the incremental encoder 310, which shows that the elevator arms 307 being held in the "reserve deck" position. The microcontroller thus commands the elevator motor 312 to raise the processed card deck 630 to the card deck discharge portal 130. Referring to FIG. 24B, as the elevator arms 307 raises the processed card deck 630, the retractable supports 131 are pivoted outwardly away by contact between the angular surfaces 131A and the lateral surfaces of the deck 630. FIG. 24C shows that the processed card deck 630 is raised slightly above the retractable supports 131, allowing them to snap back into position as urged by torsion springs 136. In FIG. 24D, the elevator arms 307 have transferred the processed card deck 630 to the retractable supports 131, and the elevator arms 307 continue moving downward. The elevator arms 307 thus transfer the processed card deck 630 from the elevator arms 307 to the retractable supports 131 by a downward motion. The elevator arms 307 are thereafter available to participate in randomizing additional card decks within the lower portion of randomizing chamber 186.

Termination of the randomizing cycle is detected by the microcontroller via sensor 129 (see FIG. 13A). Upon termination of the randomizing cycle, the microcontroller will determine if processed card deck 630 is faulty. If the processed card deck 630 is not faulty, the microcontroller will check the status of the reflective sensor 138 (FIG. 24A) which detects presence of a "ready deck". If no "ready deck" is detected, the microcontroller will commence the cycle of transferring the processed card deck 630 to the retractable supports 131 in the processed deck discharge portal 130. If a "ready deck" is present, then the microcontroller will command the elevator arms 307 to move to the footprint position and hold the processed card deck 630 in the "reserve deck" position as shown by the "reserve deck" 630(2) in FIG. 30. The microcontroller detects the presence of a deck in the "reserve deck" position by utilizing the cumulative count of the incremental encoder 310 which keeps track of the elevator height in terms of encoder register counts. For example, an encoder count of 3490 represents the elevator height at the footprint position, and an encoder count of 5340 represents the zenith of the elevator just prior to transferring a verified deck to the retractable support structure 131.

Figure 25:
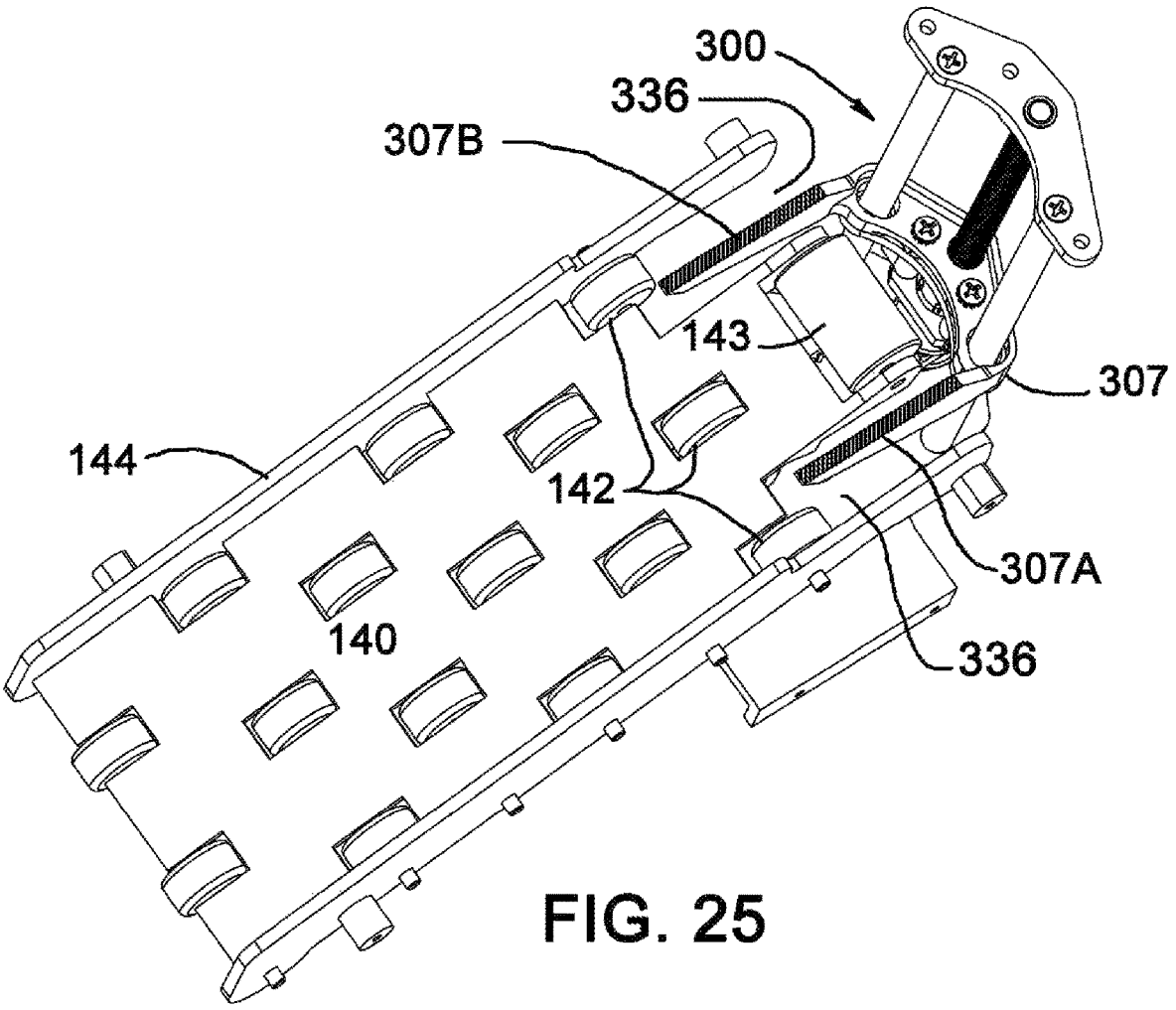
FIG. 25 is an isometric view of the elevator when withdrawn to the second discharge portal position.
Figure 26A:
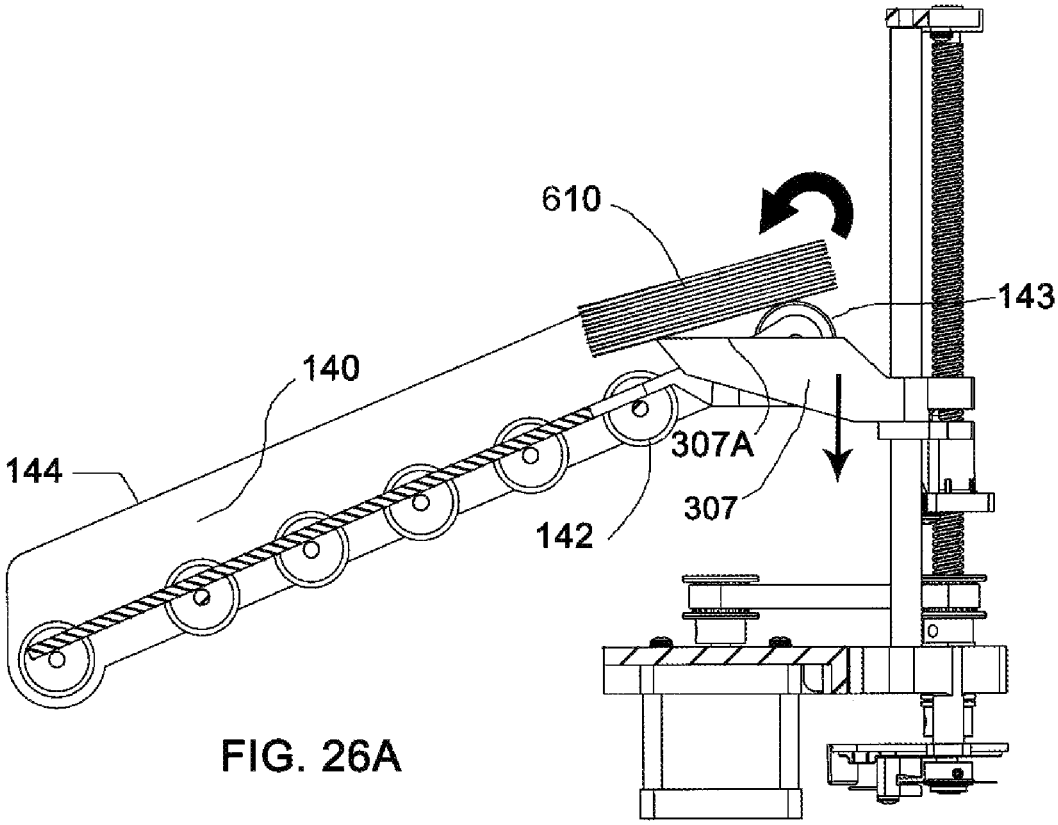
FIGS. 26A and 26B are cutaway isometric views showing a sequence of operations as a faulty card deck is transferred to the second discharge port.
Figure 26B:
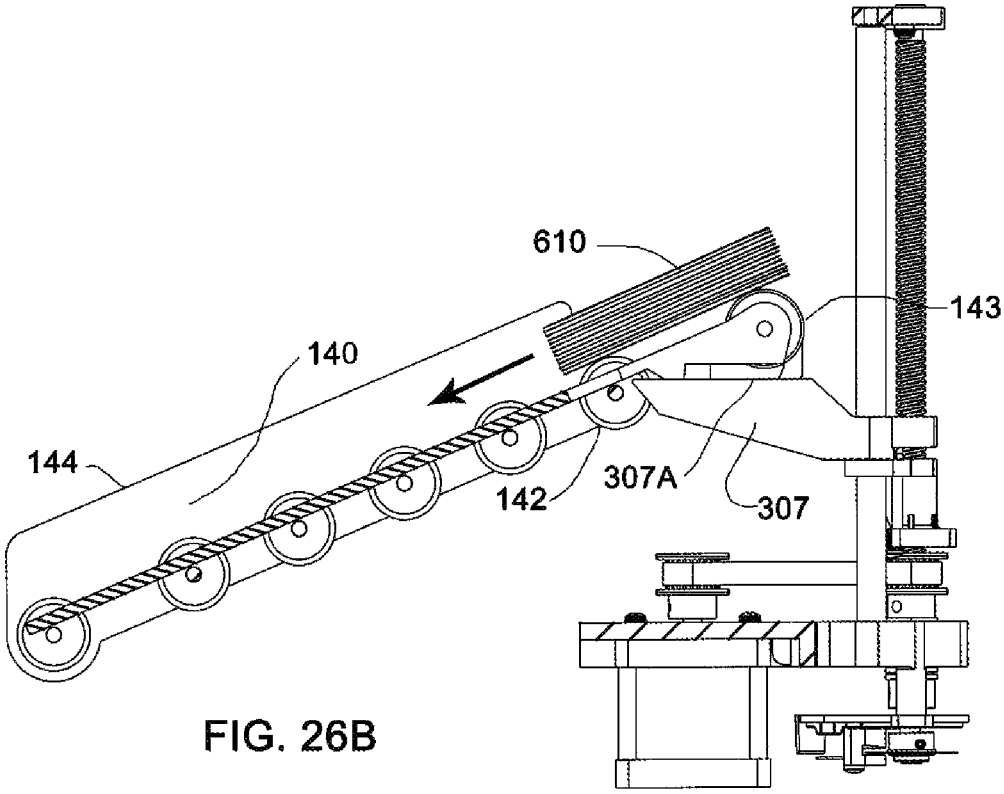

FIG. 25 illustrates an isometric view of the elevator support surfaces 307A and 307B when the elevator arms 307 are withdrawn to its lowest elevation to release a faulty card deck. In this view, the support surfaces 307A and 307B are crosshatched to help illustrate their position in the recessed openings 336 which surround the lateral sides of transfer roll 143. FIGS. 26A and 26B show isolated section views with the elevator assembly 300 and discharge port 140 showing the process of transferring the faulty card deck 610 to the rollers 142 in the discharge port 140. As the elevator arms 307 are lowered toward a discharge position in FIG. 26A, the faulty card deck 610 first makes contact with transfer roller 143, near one edge of the deck, which induces the faulty card deck 610 to begin rotating counter clockwise as indicated by the rotary arrow. In this figure, the faulty card deck 610 is partially supported by the tip of elevator surface 307A which is moving downward toward a recessed position. As the elevator arms 307 continue moving downward, the faulty card deck 610 rotates until gaining additional support from roller 142 as shown in FIG. 26B. The transfer from the elevator arms 307 to the discharge port 140 has now taken place and the faulty card deck 610 has begun moving in the direction of the arrow. It is noted that in FIG. 26B, the elevator arms 307 are in a fully retracted "discharge position" where the elevator arms 307 reside temporarily while the faulty card deck 610 travels along rollers 142 and is ejected from the apparatus.

Figure 27:
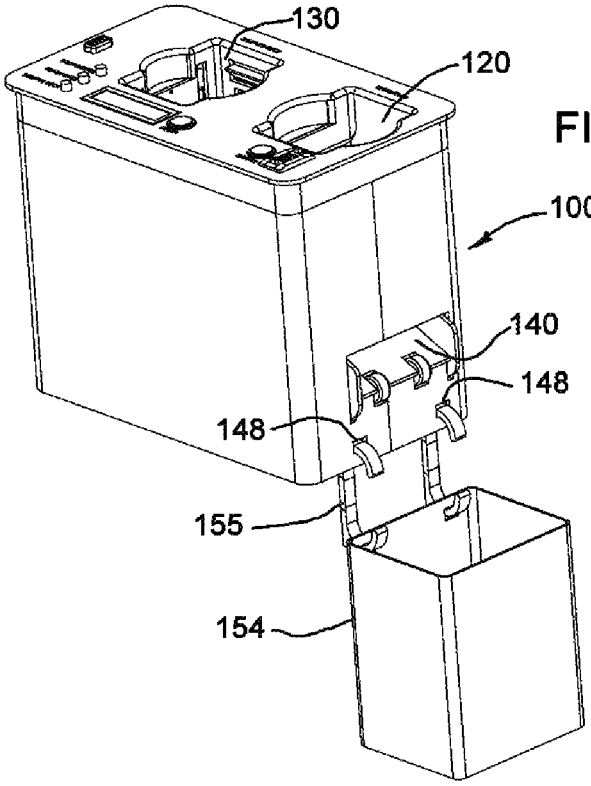
FIG. 27 shows an illustration of a faulty deck collection container attached to the apparatus adjacent to the second discharge portal, allowing faulty decks to be retained for future review by the casino.

Referring to FIG. 26B, it can be seen that the axis of the output port 140 is sloped so as to permit gravity to propel the faulty deck 610 along the axis of the arrow to the opening in the housing and into container 154 (FIG. 27). The discharge of faulty deck 610 could also be propelled by motorized means such a moving belt or conveyer as is known in the art. In a motorized variant, the axis of the faulty deck discharge motion could form a non-sloped angle with the casino table surface, or could be angled upward to a discharge port anywhere on the lateral surface of the housing. Alternately, the faulty deck 610 could be discharged directly through a port within the bottom surface of the apparatus housing by gravity.

At the time that the faulty card deck 610 is disgorged from the apparatus the microcontroller activates an indicator to alert the dealer that a faulty card deck 610 has been removed, as shown for example by the "Deck Ejected" indicator 109 in FIG. 11. In addition, the brief reason for the rejection is displayed in the display 114 as shown in FIG. 11. The microcontroller additionally records the deck removal event with a timestamp and the reason for rejection in the memory of the apparatus. Optionally, that data may be sent to a server on a network.

The controller may be field-programmable to adjust the deck rejection criteria in accordance with the policy of a given casino. For example, the deck rejection criteria may be programmed so as not to reject decks with one or more flipped cards. If desired, the apparatus could be programmed to return such decks to the "reserve deck" or "ready deck" positions such that the flipped card could be remediated by the dealer. In this case, the display would indicate a "flipped card" warning to the dealer, but the apparatus would not eject that deck. Other casinos may not opt for the dealer to waste any time in repairing a deck having flipped cards.

Once a faulty card deck 610 has been removed from the three-deck rotation, a new card deck must be added to replace the ejected card deck. The "Deck Ejected" indicator alerts the dealer to the need for inserting a new card deck into the card deck intake portal 120, which can be done between hands with only minor interruption. The microcontroller will then cease flashing of the "Deck Ejected" indicator 109 when a new card deck enters the card deck intake portal 120.

Faulty card decks 610 are discharged through the discharge port 140 in the housing of the apparatus a shown in FIG. 9. Such faulty card decks 610 could be discharged into a common wastebasket located below the casino table. Some casinos may want to manually review faulty card decks off-line (away from the table) without disturbing the card game. The apparatus possesses notches 148 as shown in FIG. 9 for the purpose of attaching a secured or unsecured container to capture the discharged faulty card decks. For example, FIG. 27 illustrates an unsecured container 154, attached to the apparatus, for capturing discharged card decks by engaging notches 148. Depending upon casino policy, the faulty deck rejection event may cause the microcontroller to signal a pit boss or personnel from security such that the faulty card deck can be taken away for inspection while the card game continues. Conversely, some casinos may not wish to interrogate each discharged faulty card deck. Furthermore, some casinos may desire that the faulty deck rejection event be silent, such that the table players remain unaware.

The astute casino card dealer will utilize the invention to sustain the rate of table play by maintaining a three-deck rotation as illustrated by the preferred embodiment shown in FIG. 30. The dealer will queue three decks as shown in FIG. 30 at the start of his shift or at the start of a new game with fresh players. In FIG. 30, the dealer has just loaded a third deck 600 into the card deck intake portal 120. The "ready deck" 630(1) resides in the processed deck discharge portal 130 as supported by the retractable supports 131 and the "reserve deck" 630(2) resides in a footprint position as supported by the elevator arms 307.

When the dealer removes the "ready deck" 630(1) to the table and commences further game play, the apparatus responds automatically. The removal of the "ready deck" 630(1) changes the state of sensor 138 (FIG. 24A) and triggers the microcontroller to move the "reserve deck" 630(2) upward and transfer that card deck to retractable supports 131. The "reserve deck" 630(2) then becomes the "ready deck" 630(1) and the elevator arms 307 then relocate to a position ready for randomizing another card deck 600 which may await in card deck intake portal 120.

The action of transferring the "reserve deck" 630(2) to the processed deck discharge portal 130 also triggers the microcontroller to interrogate the condition of the card deck intake portal 120 by checking the state of sensor 129 (FIG. 13A) and reflective sensor 138 (FIG. 24A). When sensor 129 detects the presence of a card, then the apparatus will automatically commence the next processing cycle by randomizing and interrogating the card deck that resides in the card deck intake portal 120.

The apparatus of the invention is capable of facilitating a three-deck rotation which guarantees that no faulty card deck 610 reaches the card deck discharge portal 130. With a three-deck rotation, three discrete, separate card decks may reside within the apparatus at any point in time as shown in FIG. 30. In this figure, the "ready deck" 630(1) and the "reserve deck" 630(2) were previously verified and will allow the dealer uninterrupted game play. When the dealer removes the "ready deck" 630(1) in FIG. 30, the remaining two decks 630(2), 600 will advance through the apparatus automatically and the card deck intake portal 120 will become vacant. If the deck being randomized is found to be faulty, the microcontroller will command the elevator arms 307 to disgorge it through the discharge port 140.

The invention relieves the dealer of any distraction or interruption in table play that would otherwise require a dealer to unload a shuffling apparatus and thereafter manually disassemble, reconstruct or cure contaminated card decks when such decks are detected by the microcontroller. The dealer can therefore remain confident that the casino game may continue without interruption. Alternatively, the invention denies the dealer the discretion to continue play with a corrupt card deck as in the case of player-dealer collusion. In this way, the invention prevents cheating.

The apparatus 100 herein can be utilized as a device to verify the integrity of card decks without randomizing the cards. The "verify-only" mode can be set by utilizing the push switch selector 111 on the apparatus console 105 as shown in FIG. 11. As shown in FIG. 13A, cards 620 may be stacked upon the elevator arms 307 within the randomizing chamber 186 without randomizing after interrogation by the optical recognition sensor. The interrogated non-faulty card deck is then transferred to the card deck discharge portal 130 as shown in FIG. 13B. If that card deck has been verified without error, then the "Ready Deck" indicator light 107 on the console 105 will be activated with green color (see FIG. 10). If the microcontroller detects a verification error, the faulty deck will be disgorged from the apparatus. The time for processing a card deck in the "verify-only" mode will be somewhat shorter because no randomization is needed.

During the verification only mode, the elevator surfaces 307 do not relocate for each and every card insertion cycle. Instead, the elevator surfaces 307 are incrementally moved downward by the elevator mechanism 300 to accommodate the increasing thickness of the stack 620 that accumulates upon the elevator support surface (see FIG. 13A). After each group of 13 cards accumulates on the elevator 307, the elevator is abruptly lowered by an amount equal to the thickness of 13 cards. This stack settling cycle is intended to remove air that is trapped between card layers, and is nominally performed four times during the verification of a 52-card deck. The number of cards in the stack settling cycle (13) may be modified as appropriate. The number could be as little as one, but that choice may be considered impractical by the designer of the apparatus.

Also, during the verification only mode, the cam-controlled platform 210 is cycled for each and every card insertion cycle (see FIG. 16). However, the solenoids 207 and 208 that actuate gripper arms 203 and 204 are only actuated during specific insertion cycles. Prior to each incremental stack settling cycle of the elevator 307, the cam-controlled gripper arms 203 and 204 are also actuated by solenoids 207 and 208 so as to remove accumulated trapped air from within the growing stack 620. This gripper cycle takes place just prior to each of the incremental stack settling cycles of the elevator 307. The elevator 307 moves each accumulated stack to an elevation where the gripper arms 203 and 204 may grasp the bottom of the stack 620, and the gripper arms thereafter actuated by the solenoids 207 and 208. The cam-controlled gripper mechanism 200 then raises the accumulated stack 620 and thereafter releases it, allowing the accumulated stack 620 to free fall upon the elevator surface 307 to remove accumulated air from the stack. Both the elevator mechanism 300 and the gripper arms 203 and 204 are actuated during these stack settling cycles in the verification only mode.

The relational geometry as shown in the figures is not limiting. For example, the axis formed by the lateral walls of the randomizing chamber 186 as shown in FIG. 12 may form an oblique non-perpendicular angle with the surface of the casino table. The planes which define the openings of the card intake portal 120 and the card discharge portal 130 may be offset from each other or form acute angles with the surface of the casino table. The rectangular openings of the card intake portal 120 and the card discharge portal 130 (FIG. 11) may be non-parallel with any lateral surface of the apparatus housing. Furthermore, the axis of the shuffling chamber 186 shown in FIG. 12 is not limited to a perpendicular orientation with the card intake portal 120 and the card discharge portal 130.

Referring to FIG. 13A, the cards are transported by nip rollers 162, 164, 166, 168, and 169 in that figure. However, it is noted that the cards may be transported from the input tray 120 to the randomizing chamber 186 by any other transport means that is known in the art. Also referring to that figure, it can be seen the optical recognition sensor 196 could also reside at the position of the card present sensor 129. Furthermore, the functions of the optical recognition sensor 196 and the card present sensor 129 could optionally be combined and reside at the position of sensor 129. Other sensor locations, other sensor types, and other optical recognition devices could be utilized as known and practiced in the art.

Referring to FIG. 13B, the discharge port 140 need not be sloping such that it depends upon gravity to discharge a deck of cards. Alternately, the discharge port 140 could be belt driven and oriented to exit from the shuffling chamber 186 along any other axis, including upward to the uppermost surface of the apparatus. Also, the locations of the discharge portal 130 and the discharge port 140 could be reversed in a tabletop variant of the apparatus, such that "non-faulty" decks were discharged through lateral walls of the apparatus and faulty decks were elevated to a location proximate the upper surface of the apparatus. In the latter option, a solenoid or other stopping device could be used to stage two non-faulty decks along the axis of the rollers 142 of the discharge port 140 as shown in FIG. 26B. The discharge port 140 could also be configured to pierce any other exterior surface of the housing, including the uppermost and lowermost surfaces.

Referring to FIG. 11, various control means on the control panel are shown implemented as push switches, push buttons, indicator lights and a 2-line LCD display. However, any other control means, or combinations of control means could be implemented to perform the control and status awareness functions, as is well known and practiced in the art. Those controls could also be located in different geometric orientations than shown, as for example on a control region that is elevated or angularly re-oriented away from the surface of the card intake and discharge portals. The control region could also be located on a lateral surface of the device housing in a tabletop variant of the apparatus. Moreover, the control functions could be simplified and centralized by utilizing a single or multiple touch screen displays. The control panel could also be removable from the apparatus housing so as to be more conveniently located by an operator. The operation of the control panel and the apparatus could also be monitored remotely over a network by casino personal or a centralized server.

Referring to FIG. 14, the elevator arms 307 could be translated by devices other than the lead screw 304 and stepper motor 312. For example, toothed belts or rack and pinion gears could be utilized. Cable drives and different types of motors such as linear motors or servo motors could also be utilized, as well as any other elevator moving means and sensing means as known in the art. The randomizing algorithms that are explained in FIG. 29A and FIG. 29B are not intended to be limiting. Other randomizing algorithms, as known in the art, could be implemented utilizing the fork-shaped elevator.

Referring to FIG. 16 and FIG. 17, the gripper closing function of the solenoids 207 and 208 and the return function of spring 212, could be performed by a number of alternative moving mechanisms, including servos, toothed belt drives, geared drives, rotary solenoids or any other rotatable moving means as is known and practiced in the art.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A card handling apparatus for randomizing and/or verifying integrity of at least a first individual deck of playing cards, the card handling apparatus comprising: A housing adaptable to be mounted onto a surface of a casino table or into an opening within the surface of a casino playing table; a card intake portal accessible by a dealer for receiving unshuffled cards; a first card deck discharge portal accessible by a dealer for receiving randomized and properly verified card decks from within the card handling apparatus; a second card deck discharge portal for ejecting faulty card decks from the card handling apparatus; a control panel for indicating a status of at least the first individual deck of playing cards; an optical recognition sensor configured to individually read a rank and a suit of each card within the playing cards of the card intake portal; one slot-less elevator aligned with an axis of a randomizing chamber having at least two elevator arms movable along the axis of and within the randomizing chamber; a retractable support structure located within the first discharge portal, having a first position in which the retractable support structure resides within a first discharge portal housing and a second position in which the retractable support structure is capable of moving through an opening in a wall of the portal housing to achieve the first position; a gripper mechanism located in the randomizing chamber and movable in an arcuate motion relative to the randomizing chamber axis; at least one microcontroller for directing the transport of the playing cards, deciding if an interrogated deck is faulty or "non faulty", and providing status to a card handler operator; and the elevator arms configured to relocate and transfer the interrogated card deck to either the first or second discharge portal, dependent upon a fault criteria determination of the microcontroller.

2. The card handling apparatus of claim 1, wherein a second individual deck of playing cards is received within the card intake portal and the microcontroller initiates a second randomizing cycle of the second individual deck of playing cards, such that individual cards of the second individual deck of playing cards are interrogated by the optical recognition sensor and moved to the one slot-less elevator, further wherein the second individual deck of playing cards, after interrogation, remains upon the one slot-less elevator at completion of the second randomizing cycle in a position adjacent to the first individual deck of cards located in the first card deck discharge portal.

3. The card handling apparatus of claim 2, wherein removal of the first "non-faulty" deck from the first card deck discharge portal initiates the microcontroller to interrogate a sensor status of the slot-less elevator, which indicates the presence of a second shuffled non-faulty deck of cards on the slot-less elevator.

4. The card handling apparatus of claim 3, wherein when the sensor status confirms the presence of the second shuffled "non-faulty" deck of cards, the microcontroller initiating movement of the slot-less elevator to move the second "non-faulty" shuffled deck of cards to the first discharge portal after the first shuffled "non-faulty" deck of cards is removed from the first discharge portal.

5. The card handling apparatus of claim 1, wherein actuation of the retractable support structure is based upon the relative position of the slot-less elevator.

6. The card handling apparatus of claim 1, wherein a first shuffled "non-faulty" deck of cards is transferred from the slot-less elevator to the retractable support structure after the retractable support structure is relocated to its first position.

7. The card handling apparatus of claim 1, wherein the retractable support structure comprises a pair of retractable support members.

8. The card handling apparatus of claim 1, wherein the retractable support structure is collapsible by a first shuffled "non-faulty" deck of cards.

9. The card handling apparatus of claim 1, wherein the slot-less elevator is fork-shaped.

10. The card handling apparatus of claim 1, wherein the randomizing chamber is devoid of compartments, card slots, combs, racks, carousels or ejector blades.

11. The card handling apparatus of claim 1, further comprising a randomizing mechanism comprising the gripper mechanism configured to grip and raise at least one individual card of the first individual deck of cards through an arc to create a wedge-shaped, position-tolerant opening between two stacks of the first deck of cards.

12. The card handling apparatus of claim 1, wherein the microcontroller may designate a deck as faulty if either 1) a card within that deck is unreadable by the optical recognition sensor, 2) unexpected cards are encountered, or 3) an expected card count is not satisfied.

13. The card handling apparatus of claim 12, wherein the microcontroller may command the slot-less elevator to relocate a faulty deck to the second discharge portal.

14. The card handling apparatus of claim 1, wherein the control panel further comprises a means to alert a dealer that a faulty card deck has been ejected from the apparatus.

15. The card handling apparatus of claim 1, wherein the control panel further comprises a display to alert a dealer to a verification status of a card deck that is being processed for future use.

16. The apparatus of claim 2 whereupon three separated card decks may coexist at discrete positions within the apparatus.

* * * * *